US008225624B2

(12) United States Patent
Yamaguchi et al.

(10) Patent No.: US 8,225,624 B2
(45) Date of Patent: Jul. 24, 2012

(54) REFRIGERATION SYSTEM

(75) Inventors: Takahiro Yamaguchi, Osaka (JP); Satoshi Ishikawa, Osaka (JP); Masahiro Yamada, Osaka (JP); Kazuhiro Furusho, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 1001 days.

(21) Appl. No.: 12/224,420

(22) PCT Filed: Mar. 6, 2007

(86) PCT No.: PCT/JP2007/054305

§ 371 (c)(1),
(2), (4) Date: Aug. 27, 2008

(87) PCT Pub. No.: WO2007/102496

PCT Pub. Date: Sep. 13, 2007

(65) Prior Publication Data

US 2009/0013714 A1 Jan. 15, 2009

(30) Foreign Application Priority Data

Mar. 9, 2006 (JP) ..... 2006-064539

(51) Int. Cl.
*F25B 1/10* (2006.01)
*F25B 7/00* (2006.01)

(52) U.S. Cl. ..... 62/510; 62/175

(58) Field of Classification Search ..... 62/5–513; 417/44.1, 204, 417, 62, 244, 269, 273, 415, 417/426, 427, 319, 320, 321, 326, 466, 467, 417/534, 539; 418/6, 11, 13, 15, 23, 45, 418/60, 63, 146, 151, 158, 229, 235, 12, 418/145

See application file for complete search history.

(56) References Cited

U.S. PATENT DOCUMENTS

| | | | | |
|---|---|---|---|---|
| 4,531,899 | A * | 7/1985 | Sudbeck et al. | 418/59 |
| 5,050,233 | A * | 9/1991 | Hitosugi et al. | 417/427 |
| 5,170,636 | A * | 12/1992 | Hitosugi | 62/175 |
| 6,280,168 | B1 | 8/2001 | Matsumoto et al. | |
| 6,283,723 | B1 * | 9/2001 | Milburn et al. | 417/273 |
| 6,651,458 | B1 * | 11/2003 | Ebara et al. | 62/510 |
| 6,769,267 | B2 * | 8/2004 | Ebara et al. | 62/296 |

FOREIGN PATENT DOCUMENTS

CN 1279357 1/2001

(Continued)

*Primary Examiner* — Frantz Jules
*Assistant Examiner* — Emmanuel Duke
(74) *Attorney, Agent, or Firm* — Birch, Stewart, Kolasch & Birch, LLP

(57) ABSTRACT

A compressor (20) is provided with compression mechanisms (61, 62) to have four compression chambers (61, 62, 63, 64) in total. In the compressor (20), the first compression chamber (61) and the second compression chamber (62) differ in the phase of capacity changing cycle from each other by 180° and the third compression chamber (63) and the fourth compression chamber (64) also differ in the phase of capacity changing cycle from each other by 180°. In a cylinder non-operating mode, refrigerant is compressed in a single stage in each of the first compression chamber (61) and the second compression chamber (62) while the refrigerant compression operation is halted in the third compression chamber (63) and the fourth compression chamber (64). In a two-stage compression mode, refrigerant compressed in a single stage in each of the first compression chamber (61) and the second compression chamber (62) is further compressed in the third compression chamber (63) and the fourth compression chamber (64).

8 Claims, 13 Drawing Sheets

FOREIGN PATENT DOCUMENTS

| | | | | |
|---|---|---|---|---|
| CN | 1431402 | | | 7/2003 |
| JP | 64-10066 | A | | 1/1989 |
| JP | 64-36689 | A1 | | 3/1989 |
| JP | 64-080790 | | * | 3/1989 |
| JP | 2003-148365 | | * | 5/2003 |
| WO | WO-2005/103496 | A1 | | 11/2005 |
| WO | WO-2005/124156 | A1 | | 12/2005 |

* cited by examiner

REFRIGERATION SYSTEM

TECHNICAL FIELD

This invention relates to refrigeration systems including a compressor with a plurality of compression chambers and operable in a refrigeration cycle.

BACKGROUND ART

Refrigeration systems including a refrigerant circuit operating in a refrigeration cycle by circulating refrigerant therethrough have conventionally been widely used, such as for air conditioners.

For example, Patent Document 1 discloses an air conditioner including a twin-cylinder compressor. The refrigerant circuit of this air conditioner is provided with a compressor, an indoor heat exchanger, an expansion valve, an outdoor heat exchanger and other components. The compressor includes a drive motor, a drive shaft that can be driven by the drive motor, and first and second compression mechanisms connected to the drive shaft. The two compression mechanisms are composed of so-called rotary compression mechanisms in which a piston eccentrically rotates in the cylinder chamber in a cylinder. In other words, each compression mechanism constitutes a positive-displacement fluid machine in which the capacity of a compression chamber for refrigerant formed in the cylinder chamber cyclically changes.

In this air conditioner, the compression mode of the compressor can be changed by changing the flow path of refrigerant depending on the operating conditions. Specifically, the compressor of this air conditioner can be switched among a parallel compression mode, a cylinder nonoperating mode and a two-stage compression mode.

In the parallel compression mode, refrigerant flow is distributed to the first and second compression mechanisms and refrigerant is compressed in a single stage in each of the compression mechanisms. In the cylinder nonoperating mode, refrigerant is compressed only in the first compression mechanism and is not compressed in the second compression mechanism. In the two-stage compression mode, refrigerant is first compressed in the first compression mechanism and then further compressed in the second compression mechanism. In other words, in the two-stage compression mode, refrigerant is compressed in two stages in such a manner that the first compression mechanism is used as a low-pressure stage compression mechanism and the second compression mechanism is used as a high-pressure stage compression mechanism.

Patent Document 1: Published Japanese Patent Application No. S64-10066

DISCLOSURE OF THE INVENTION

Problems to be Solved by the Invention

In compression mechanisms consisting of positive-displacement fluid machines as mentioned above, the refrigerant compression operation is performed so that the capacity of the compression chamber cyclically changes. Specifically, in the compression operation, refrigerant is sucked into the compression chamber with increasing capacity of the compression chamber with rotation of the piston and, then, the pressure of the sucked refrigerant gradually increases with decreasing capacity of the compression chamber. Then, when the refrigerant pressure reaches a maximum, a discharge valve having closed the compression chamber is opened so that refrigerant is discharged from the compression chamber. As seen from the above, in the compression mechanisms, the capacity of the compression chamber changes cyclically in each turn of the drive shaft and the refrigerant pressure in the compression chamber changes cyclically with the cyclical change in the capacity of the compression chamber. In turn, with change in the refrigerant pressure in the compression chamber, the torque (compression torque) of the drive shaft also changes.

Meanwhile, in such twin-cylinder compressors as disclosed in Patent Document 1, the compression torque of the drive shaft is more likely to change particularly in the above cylinder nonoperating mode and two-stage compression mode.

Specifically, in the above cylinder nonoperating mode, refrigerant is not compressed in the second compression mechanism but the refrigerant compression operation is performed only in the first compression mechanism. Therefore, the compression torque of the drive shaft is influenced only by the refrigerant pressure in the compression chamber of the first compression mechanism. Thus, when the change in the refrigerant pressure in the compression chamber of the first compression mechanism becomes large, the compression torque of the drive shaft changes to a large degree.

Furthermore, in the above two-stage compression mode, the low-pressure stage, first compression mechanism generally has a larger refrigerant compression ratio than the high-pressure stage, second compression mechanism. Therefore, the compression torque of the drive shaft is more likely to be influenced by the refrigerant compression operation of the first compression mechanism having a larger compression ratio. Thus, also in the two-stage compression mode, when the change in the refrigerant pressure in the compression chamber of the first compression mechanism becomes large, the compression torque of the drive shaft is likely to change.

As described so far, in the conventional twin-cylinder compressors, the compression torque is likely to change in the cylinder nonoperating mode and the two-stage compression mode. In turn, if the compression torque changes to a large degree in the above manner, this may invite increased vibration and noise of the compressor.

The present invention has been made in view of the foregoing points and, therefore, an object of thereof is that a refrigeration system including a compressor with a plurality of compression chambers effectively reduces the change in the compression torque of the drive shaft in the cylinder non-operating mode and the two-stage compression mode.

Means to Solve the Problems

A refrigeration system according to a first aspect of the invention includes: a compressor (20) that includes a compressor main unit (30) constituting a positive-displacement fluid machine with a plurality of compression chambers (61, 62, 63, 64) to cyclically change the capacities of the compression chambers (61, 62, 63, 64) and a drive shaft (23) for driving the compressor main unit (30); and a refrigerant circuit (10) connected with the compressor (20) and operable in a refrigeration cycle, wherein the compressor main unit (30) is configured so that first and second said compression chambers (61, 62) differ in the phase of capacity changing cycle from each other by 180° and third and fourth said compression chambers (63, 64) differ in the phase of capacity changing cycle from each other by 180°, and the compressor (20) is selectively operable in a parallel compression mode in which refrigerant is compressed in a single stage in each of the first to fourth compression chambers (61, 62, 63, 64) and a cylinder nonoperating mode in which refrigerant is compressed in a single stage in each of the third and fourth compression chambers (63, 64) while compression of refrigerant in the first and second compression chambers (61, 62) is halted. The term "capacity changing cycle of the compression chamber" means the cycle in which the capacity of the compression chamber changes during one orbital motion of the piston or the like due to one turn of the drive shaft and, in other words, the cycle in which the refrigerant pressure in the compression chamber changes with change in the capacity of the compression chamber.

In the first aspect of the invention, unlike conventional twin-cylinder compressors, first to fourth compression chambers (61, 62, 63, 64) are formed in the compressor main unit (30) of the compressor (20). In the compressor (20), its refrigerant compression operation is performed by cyclically changing the capacity of each compression chamber (61, 62, 63, 64). Furthermore, in the refrigeration system, the compressor (20) can operate in the following parallel compression mode or cylinder nonoperating mode.

In the parallel compression mode, refrigerant is compressed in a single stage in each of the first to fourth compression chambers (61, 62, 63, 64). In this case, in the compressor (20), the first compression chamber (61) and the second compression chamber (62) differ in the phase of capacity changing cycle from each other by 180° and the third compression chamber (63) and the fourth compression chamber (64) also differ in the phase of capacity changing cycle from each other by 180°. Thus, the first compression chamber (61) and the second compression chamber (62) differ in the phase of changing cycle of refrigerant pressure from each other by 180° and the third compression chamber (63) and the fourth compression chamber (64) also differ in the phase of changing cycle of refrigerant pressure from each other by 180°. Therefore, during one turn of the drive shaft (23), the first compression chamber (61) and the second compression chamber (62) differ also in the phase at the maximum refrigerant pressure from each other by 180° and the third compression chamber (63) and the fourth compressor chamber (64) also differ in the phase at the maximum refrigerant pressure from each other by 180°. This results in reduced change in the compression torque of the drive shaft (23) in the parallel compression mode.

On the other hand, in the cylinder nonoperating mode, the refrigerant compression operation is not performed in the first compression chamber (61) and the second compression chamber (62) but performed in the third compression chamber (63) and the fourth compression chamber (64). Also in the cylinder nonoperating mode, since the third compression chamber (63) and the fourth compression chamber (64) differ in the phase of capacity changing cycle from each other by 180°, they differ also in the phase at the maximum refrigerant pressure from each other by 180°. This results in effectively reduced change in the compression torque of the drive shaft (23) in the cylinder nonoperating mode.

A refrigeration system according to a second aspect of the invention includes: a compressor (20) that includes a compressor main unit (30) constituting a positive-displacement fluid machine with a plurality of compression chambers (61, 62, 63, 64) to cyclically change the capacities of the compression chambers (61, 62, 63, 64) and a drive shaft (23) for driving the compressor main unit (30); and a refrigerant circuit (10) connected with the compressor (20) and operable in a refrigeration cycle, wherein the compressor main unit (30) is configured so that first and second said compression chambers (61, 62) differ in the phase of capacity changing cycle from each other by 180° and third and fourth said compression chambers (63, 64) differ in the phase of capacity changing cycle from each other by 180°, and the compressor (20) is selectively operable in a parallel compression mode in which refrigerant is compressed in a single stage in each of the first to fourth compression chambers (61, 62, 63, 64) and a two-stage compression mode in which refrigerant compressed in a single stage in each of the first and second compression chambers (61, 62) is further compressed in the third and fourth compression chambers (63, 64).

In the second aspect of the invention, the compressor (20) operates selectively in the above parallel compression mode and two-stage compression mode. Therefore, in the parallel compression mode, change in compression torque can be reduced in the same manner as in the first aspect of the invention.

On the other hand, in the two-stage compression mode in this aspect of the invention, refrigerant is first compressed in a single stage in each of the first compression chamber (61) and the second compression chamber (62). The refrigerant compressed in the first compression chamber (61) and the second compression chamber (62) is further compressed in the third compression chamber (63) and the fourth compression chamber (64). In other words, in the two-stage compression mode in this aspect of the invention, refrigerant is compressed in two stages in such a manner that the first compression chamber (61) and the second compression chamber (62) constitute low-pressure stage compression chambers and the third compression chamber (63) and the fourth compression chamber (64) constitute high-pressure stage compression chambers.

In this case, in this aspect of the invention, the first compression chamber (61) and the second compression chamber (62), both of which are likely to change in their refrigerant pressures because of relatively large compression ratio, differ in the phase of capacity changing cycle from each other by 180°. As a result, the first compression chamber (61) and the second compression chamber (62) differ also in the phase at the maximum refrigerant pressure from each other by 180°, thereby effectively reducing the change in compression torque in the two-stage compression mode.

A refrigeration system according to a third aspect of the invention includes: a compressor (20) that includes a compressor main unit (30) constituting a positive-displacement fluid machine with a plurality of compression chambers (61, 62, 63, 64) to cyclically change the capacities of the compression chambers (61, 62, 63, 64) and a drive shaft (23) for driving the compressor main unit (30); and a refrigerant circuit (10) connected with the compressor (20) and operable in a refrigeration cycle, wherein the compressor main unit (30) is configured so that first and second said compression chambers (61, 62) differ in the phase of capacity changing cycle from each other by 180° and third and fourth said compression chambers (63, 64) differ in the phase of capacity changing cycle from each other by 180°, and the compressor (20) is selectively operable in a two-stage compression mode in which refrigerant compressed in a single stage in each of the first and second compression chambers (61, 62) is further compressed in the third and fourth compression chambers (63, 64) and a cylinder nonoperating mode in which refrigerant is compressed in a single stage in each of the third and fourth compression chambers (63, 64) while compression of refrigerant in the first and second compression chambers (61, 62) is halted.

In the third aspect of the invention, the compressor (20) operates selectively in the above two-stage compression mode and cylinder nonoperating mode. Therefore, in the two-stage compression mode, change in compression torque can be reduced in the same manner as in the second aspect of the invention. Furthermore, in the parallel compression mode, change in compression torque can be reduced in the same manner as in the first aspect of the invention.

A refrigeration system according to a fourth aspect of the invention includes: a compressor (20) that includes a compressor main unit (30) constituting a positive-displacement fluid machine with a plurality of compression chambers (61, 62, 63, 64) to cyclically change the capacities of the compression chambers (61, 62, 63, 64) and a drive shaft (23) for driving the compressor main unit (30); and a refrigerant circuit (10) connected with the compressor (20) and operable in a refrigeration cycle, wherein the compressor main unit (30) is configured so that first and second said compression chambers (61, 62) differ in the phase of capacity changing cycle from each other by 180° and third and fourth said compression chambers (63, 64) differ in the phase of capacity changing cycle from each other by 180°, and the compressor (20) is selectively operable in a parallel compression mode in which refrigerant is compressed in a single stage in each of the first to fourth compression chambers (61, 62, 63, 64), a cylinder nonoperating mode in which refrigerant is compressed in a single stage in each of the third and fourth compression chambers (63, 64) while compression of refrigerant in the first and second compression chambers (61, 62) is halted and a two-stage compression mode in which refrigerant compressed in a single stage in each of the first and second compression chambers (61, 62) is further compressed in the third and fourth compression chambers (63, 64).

In the fourth aspect of the invention, the compressor (20) operates selectively in the above parallel compression mode, cylinder nonoperating mode and two-stage compression mode. Therefore, in the parallel compression mode and the cylinder nonoperating mode, change in compression torque can be reduced in the same manner as in the first aspect of the invention. Furthermore, in the two-stage compression mode, change in compression torque can be reduced in the same manner as in the second aspect of the invention.

A fifth aspect of the invention is the refrigeration system according to any one of the first to fourth aspects of the invention, wherein the compressor main unit (30) of the compressor (20) includes a first compression mechanism (24) and a second compression mechanism (25), each of the first and second compression mechanisms (24, 25) includes a cylinder (52, 56) forming an annular cylinder chamber (54, 58) and an annular piston (53, 57) placed in the cylinder chamber (54, 58) to partition the cylinder chamber (54, 58) into an inner space and an outer space and is configured to cause relative eccentric rotational motion between the cylinder (52, 56) and the piston (53, 57) with rotation of the drive shaft (23), the outer space in the cylinder chamber (54) of the first compression mechanism (24) constitutes the first compression chamber (61) and the inner space therein constitutes the third compression chamber (63), and the outer space in the cylinder chamber (58) of the second compression mechanism (25) constitutes the second compression chamber (62) and the inner space therein constitutes the fourth compression chamber (64).

In the fifth aspect of the invention, the compressor (20) is provided with the first compression mechanism (24) and the second compression mechanism (25). In each of the compression mechanisms (24, 25), an annular piston (53, 57) is placed in an annular cylinder chamber (54, 58). As a result, each cylinder chamber (54, 58) is partitioned into a space outside of the piston (53, 57) and a space inside thereof and these spaces constitute compression chambers. Furthermore, in the first compression mechanism (24), as the cylinder (52) and the piston (53) cause relative eccentric rotational motion with rotation of the drive shaft (23), the first compression chamber (61) formed outside of the piston (53) and the third compression chamber (63) formed inside of the piston (53) change their capacities. On the other hand, in the second compression mechanism (25), as the cylinder (56) and the piston (57) cause relative eccentric rotational motion with rotation of the drive shaft (23), the second compression chamber (62) formed outside of the piston (57) and the fourth compression chamber (64) formed inside of the piston (57) change their capacities.

The above two compression mechanisms (24, 25) are connected to the drive shaft (23) so that the first compression chamber (61) and the second compression chamber (62) differ in the phase of capacity changing cycle from each other by 180° and that the third compression chamber (63) and the fourth compression chamber (64) also differ in the phase of capacity changing cycle from each other by 180°. Therefore, when the compressor (20) operates in each of the above parallel compression mode, cylinder nonoperating mode and two-stage compression mode, change in compression torque can be reduced.

A sixth aspect of the invention is the refrigeration system according to any one of the first to fourth aspects of the invention, wherein the compressor main unit (30) of the compressor (20) includes first to fourth rotary compression mechanisms (24, 25, 26, 27) that form their respective compression chambers (61, 62, 63, 64) corresponding to the first to fourth compression chambers (61, 62, 63, 64), respectively.

In the sixth aspect of the invention, unlike the above-stated fifth aspect of the invention, the compressor (20) is provided with first to fourth compression mechanisms (24, 25, 26, 27). These compression mechanisms (24, 25, 26, 27) are constituted by rotary compression mechanisms in each of which a piston is contained in a cylinder chamber and have their respective first to fourth compression chambers (61, 62, 63, 64) formed therein.

The above four compression mechanisms (24, 25, 26, 27) are connected to the drive shaft (23) so that the first compression chamber (61) and the second compression chamber (62) differ in the phase of capacity changing cycle from each other by 180° and that the third compression chamber (63) and the fourth compression chamber (64) also differ in the phase of capacity changing cycle from each other by 180°. Therefore, when the compressor (20) operates in each of the above parallel compression mode, cylinder nonoperating mode and two-stage compression mode, change in compression torque can be reduced.

A seventh aspect of the invention is the refrigeration system according to the sixth aspect of the invention, wherein the first compression chamber (61) differs in the phase of capacity changing cycle from one of the third compression chamber (63) and the fourth compression chamber (64) by 180°.

In the seventh aspect of the invention, the phases of capacity changing cycles of the compression chambers (61, 62, 63, 64) in the four rotary compression mechanisms (24, 25, 26, 27) are set so that centrifugal forces due to eccentric rotations of their respective pistons can be canceled out. Specifically, in this aspect of the invention, the first compression chamber (61) and the third compression chamber (63) are made different in the phase of capacity changing cycle from each other by 180° and, concurrently, the second compression chamber (62) and the fourth compression chamber (64) are made different in the phase of capacity changing cycle from each other by 180°. Alternatively, the first compression chamber (61) and the fourth compression chamber (64) are made different in the phase of capacity changing cycle from each other by 180° and, concurrently, the second compression chamber (62) and the third compression chamber (63) are made different in the phase of capacity changing cycle from each other by 180°. As a result, in the compressor (20), two pistons in the four compression mechanisms (24, 25, 26, 27) have a relationship of phase difference of 180° with respect to the drive shaft (23) and the remaining two also have a relationship of phase difference of 180° with respect to the drive shaft (23). Therefore, in the compressor (20), the centrifugal forces of pistons eccentrically rotating pairwise are canceled out each other, whereby change in the torque of the drive shaft (23) can be reduced.

EFFECTS OF THE INVENTION

In the present invention, the compressor main unit (30) of the compressor (20) is provided with four compression chambers (61, 62, 63, 64), the first compression chamber (61) and the second compression chamber (62) are made different in the phase of capacity changing cycle from each other by 180° and the third compression chamber (63) and the fourth compression chamber (64) are also made different in the phase of capacity changing cycle from each other by 180°. Therefore, in the above cylinder nonoperating mode, the third compression chamber (63) and the fourth compression chamber (63) differ in the phase of changing cycle of refrigerant pressure from each other by 180°, whereby change in compression torque in the cylinder nonoperating mode can be reduced. This provides reduced vibration and noise of the compressor (20) in the cylinder nonoperating mode.

Furthermore, also in the two-stage compression mode, the first compression chamber (61) and the second compression chamber (62) both having relatively large compression ratio differ in the phase of changing cycle of refrigerant pressure from each other by 180°, whereby the compression torque in the two-stage compression mode can be effectively reduced. Furthermore, also in the parallel compression mode, the first compression chamber (61) and the third compression chamber (63) differ in the phase of changing cycle of refrigerant pressure from each other by 180° and the third compression chamber (63) and the fourth compression chamber (64) also differ in the phase of changing cycle of refrigerant pressure from each other by 180°. Therefore, the compression torque in the parallel compression mode can be reduced.

In addition, according to the fifth aspect of the invention, the compressor (20) of the type in which two compression chambers are formed in each of two compression mechanisms (24, 25) can reduce the compression torque in each of the above-stated compression modes.

Furthermore, in the fifth aspect of the invention, the spaces in the cylinder chambers (54, 58) located outside of the pistons (53, 57) constitute the first compression chamber (61) and the second compression chamber (62). In this case, the spaces outside of the pistons (53, 57) have larger capacities according to larger curvature radii than the spaces inside of the pistons (53, 57). Therefore, the displacements of the first compression chamber (61) and the second compression chamber (62) both serving as low-pressure stage compression chambers in the two-stage compression mode can be increased, thereby effectively compressing refrigerant in two stages.

In addition, according to the sixth aspect of the invention, the compressor (20) of the type in which a single compression chamber is formed in each of four compression mechanisms (24, 25, 26, 27) can reduce the compression torque in each of the above-stated compression modes.

Particularly, according to the seventh aspect of the invention, the centrifugal forces of two pistons in the four compression mechanisms (24, 25, 26, 27) can be canceled out with those of the other two pistons, whereby the mechanical torque change of the drive shaft (23) can be reduced. Thus, according to this aspect of the invention, vibration and noise of the compressor (20) can be further effectively reduced.

LIST OF REFERENCE NUMERALS

Figure 1:
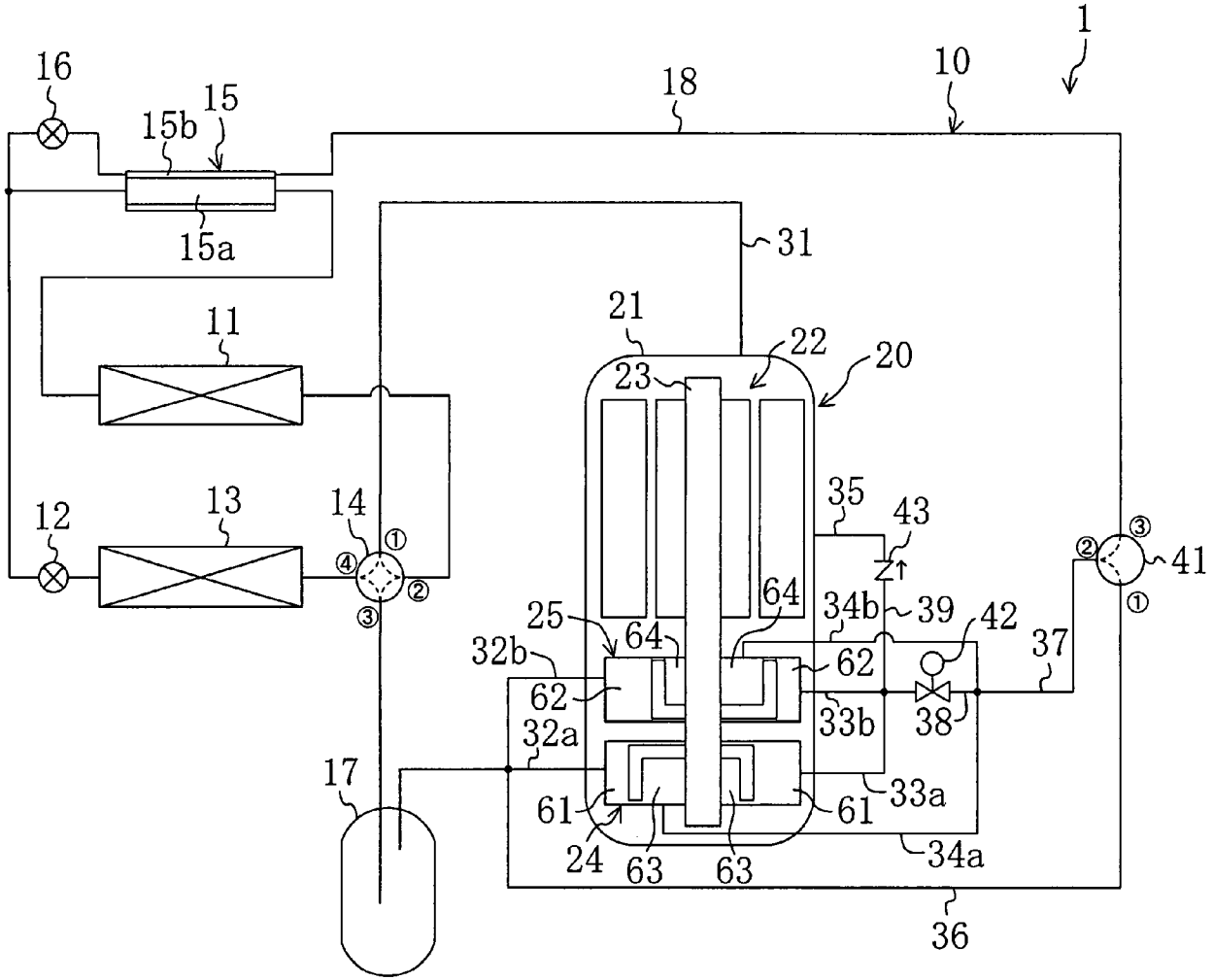
FIG. 1 is a piping diagram of a refrigerant circuit of an air conditioner according to Embodiment 1.

1 air conditioner
10 refrigerant circuit
20 compressor
23 drive shaft
24 first compression mechanism
25 second compression mechanism
26 third compression mechanism
27 fourth compression mechanism
30 compressor main unit
52 first cylinder
53 first piston
54 first cylinder chamber
56 second cylinder
57 second piston
58 second cylinder chamber
61 first compression chamber
62 second compression chamber
63 third compression chamber
64 fourth compression chamber

BEST MODE FOR CARRYING OUT THE INVENTION

Embodiments of the present invention will be described below in detail with reference to the drawings.

<<Embodiment 1>>

A refrigeration system according to an embodiment of the present invention constitutes an air conditioner (1) that selectively performs heating and cooling of a room. The air conditioner (1) includes a refrigerant circuit (10) operating in a refrigeration cycle by circulating refrigerant therethrough and constitutes a so-called heat pump air conditioner.

As shown in FIG. 1, the refrigerant circuit (10) includes, as main components, a compressor (20), an indoor heat exchanger (11), an expansion valve (12) and an outdoor heat exchanger (13).

The indoor heat exchanger (11) is placed in an indoor unit. The indoor heat exchanger (11) exchanges heat between indoor air fed by an indoor fan and refrigerant. The outdoor heat exchanger (13) is placed in an outdoor unit. The outdoor heat exchanger (13) exchanges heat between outdoor air fed by an outdoor fan and refrigerant. The expansion valve (12) is disposed in the refrigerant circuit (10) between the indoor heat exchanger (11) and the outdoor heat exchanger (13). The expansion valve (12) is composed of an electronic expansion valve controllable in opening.

The refrigerant circuit (10) further includes a four-way selector valve (14), an internal heat exchanger (15), a pressure reduction valve (16) and a liquid receiver (17).

The four-way selector valve (14) has first to fourth ports. In the four-way selector valve (14), the first port is connected to the discharge side of the compressor (20), the second port is connected to the indoor heat exchanger (11), the third port is connected via the liquid receiver (17) to the suction side of the compressor (20) and the fourth port is connected to the outdoor heat exchanger (13). The four-way selector valve (14) is configured to be switchable between a position in which the first and second ports are communicated with each other and the third and fourth ports are communicated with each other and a position in which the first and fourth ports are communicated with each other and the second and third ports are communicated with each other.

The internal heat exchanger (15) constitutes a double-pipe heat exchanger having a first heat-exchange channel (15*a*) and a second heat-exchange channel (15*b*). The first heat-exchange channel (15*a*) is disposed to extend halfway along a refrigerant pipe between the indoor heat exchanger (11) and the expansion valve (12). The second heat-exchange channel (15*b*) is disposed to extend halfway along an intermediate injection pipe (18) branched from a point of the refrigerant circuit between the internal heat exchanger (15) and the expansion valve (12). The intermediate injection pipe (18) is provided with the pressure reduction valve (16) upstream of the internal heat exchanger (15). In the internal heat exchanger (15), heat can be exchanged between high-pressure liquid refrigerant flowing through the first heat-exchange channel (15*a*) and intermediate-pressure refrigerant flowing through the second heat-exchange channel (15*b*).

The refrigerant circuit (10) further includes first to fourth bypass pipes (36, 37, 38, 39) and a three-way valve (41) having three ports.

The first bypass pipe (36) is connected at one end to a first suction pipe (32*a*) and a second suction pipe (32*b*) of the compressor (20) and connected at the other end to the first port of the three-way valve (41). The second bypass pipe (37) is connected at one end to the second port of the three-way valve (41) and connected at the other end to a first suction communication pipe (34*a*) and a second suction communication pipe (34*b*) of the compressor (20). The third port of the three-way valve (41) is connected to the outflow end of the intermediate injection pipe (18). The three-way valve (41) is configured to be switchable between a position in which the first and third ports are communicated with each other and the third port is closed and another position in which the second and third ports are communicated with each other and the first port is closed.

The third bypass pipe (38) is connected at one end to a first discharge communication pipe (33*a*) and a second discharge communication pipe (33*b*) of the compressor (20) and connected at the other end to the first suction communication pipe (34*a*) and the second suction communication pipe (34*b*) of the compressor (20). The third bypass pipe (38) is provided with a solenoid shut-off valve (42) for opening and closing the flow path of refrigerant.

The fourth bypass pipe (39) is connected at one end to the first discharge communication pipe (33*a*) and the second discharge communication pipe (33*b*) of the compressor (20) and connected at the other end to a branch communication pipe (35) of the compressor (20). The fourth bypass pipe (39) is provided with a check valve (43) that inhibits the refrigerant flow in the direction from the branch communication pipe (35) to the discharge communication pipes (33*a*, 33*b*) but admits the opposite refrigerant flow.

Figure 2:
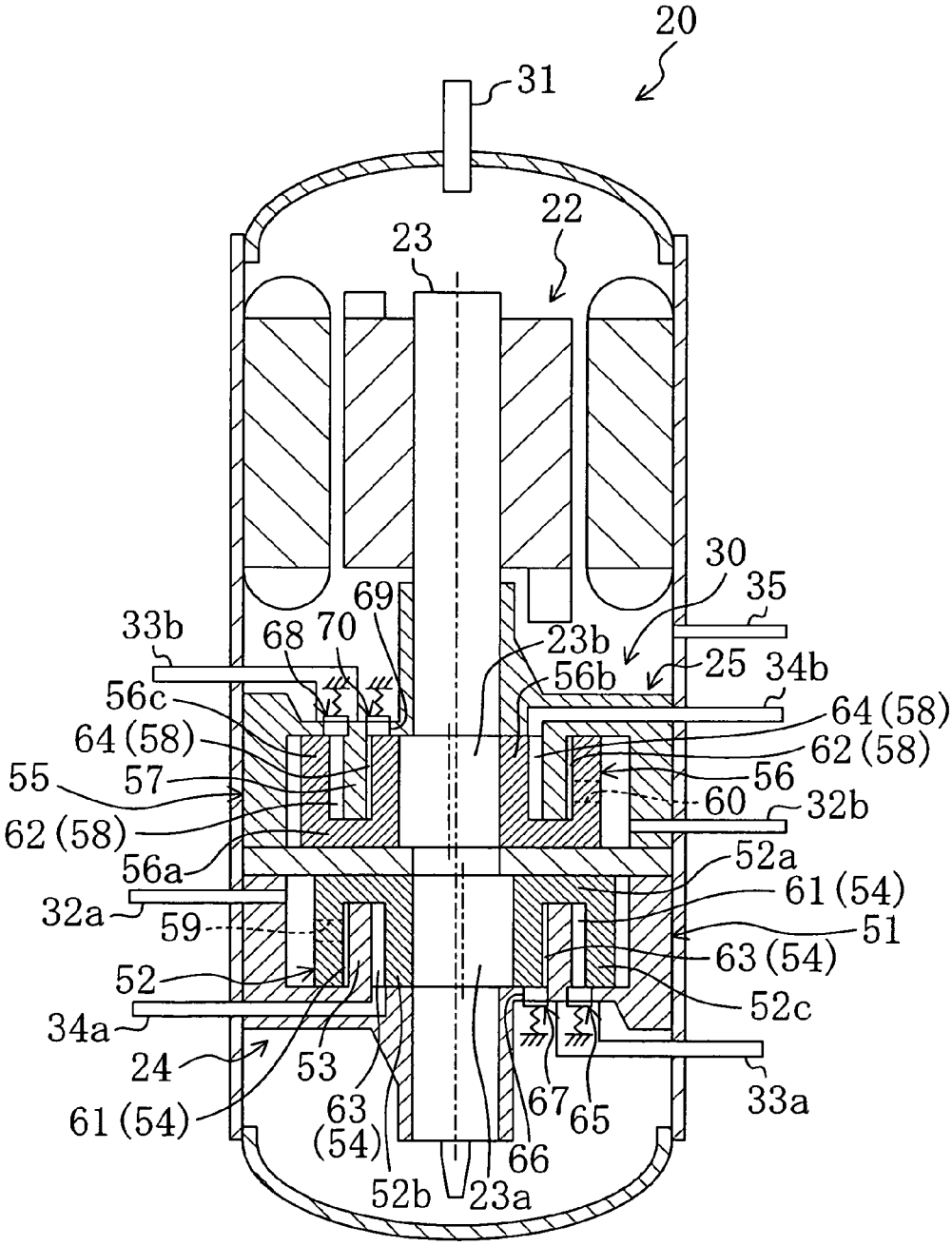
FIG. 2 is a longitudinal cross-sectional view of a compressor.
Figure 3A:
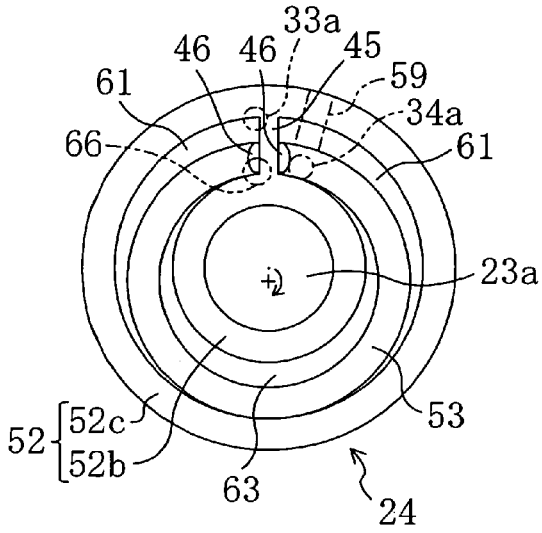
FIG. 3 is a transverse cross-sectional view of a first compression mechanism (second compression mechanism).
Figure 3C:
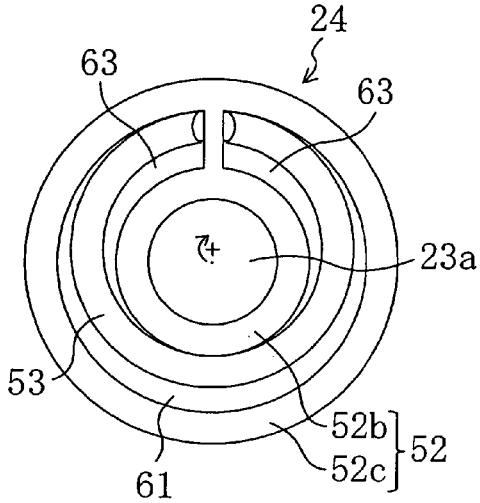
Figure 3B:
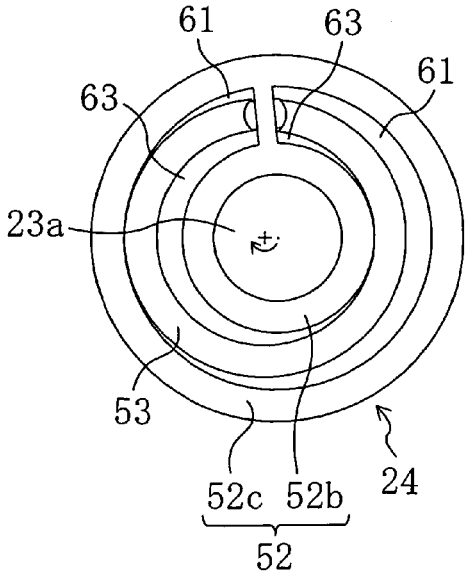
Figure 3D:
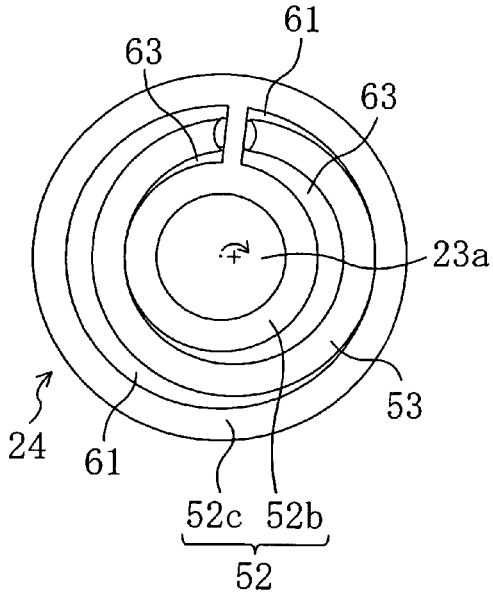

As shown in FIG. 2, in the compressor (20), a compressor main unit (30) including an electric motor (22), a drive shaft (23) and two compression mechanisms (24, 25) is contained in an enclosed casing (21). The compressor (21) is constituted by a high-pressure domed compressor in which the casing (21) is filled with high-pressure refrigerant.

The electric motor (22) is disposed in an upper part of the casing (21). The drive shaft (23) vertically passes through the electric motor (22). The drive shaft (23) is configured to be rotatable by being driven by the electric motor (22). The drive shaft (23) has a first eccentric part (23*a*) formed in a portion thereof towards its lower end and a second eccentric part (23*b*) formed in a portion thereof towards its middle point. The first eccentric part (23*a*) and the second eccentric part (23*b*) are off-center from the axis of the drive shaft (23). Furthermore, the first eccentric part (23*a*) and the second eccentric part (23*b*) are different in phase from each other by 180° with respect to the axis of the drive shaft (23).

The compressor main unit (30) is disposed around a lower part of the drive shaft (23). The compressor main unit (30) includes a first compression mechanism (24) located towards the bottom of the casing (21) and a second compression mechanism (25) located towards the electric motor (22). The rotational speed of the drive shaft (23) can be changed by inverter control. In other words, both the compression mechanisms (24, 25) constitute variable-displacement, inverter compression mechanisms.

The first compression mechanism (24) includes a first housing (51) fixed to the casing (21) and a first cylinder (52) contained in the first housing (51). Disposed inside the first housing (51) is an annular first piston (53) extending upward.

The first cylinder (52) includes a disc-shaped end plate (52*a*), an annular inner cylindrical part (52*b*) extending downward from the inner peripheral end of the end plate (52*a*) and an annular outer cylindrical part (52*c*) extending downward from the outer peripheral end of the end plate (52*a*). The first eccentric part (23*a*) is fitted into the inner cylindrical part (52*b*) of the first cylinder (52). The first cylinder (52) is configured to eccentrically rotate about the axis of the first eccentric part (23*a*) with rotation of the drive shaft (23).

Furthermore, the first cylinder (52) has an annular first cylinder chamber (54) defined between the outer periphery of the inner cylindrical part (52*b*) and the inner periphery of the outer cylindrical part (52*c*). Disposed in the first cylinder chamber (54) is the first piston (53). As a result, the first cylinder chamber (54) is partitioned into a first compression chamber (61) formed between the outer periphery of the first piston (53) and the outside inner wall of the first cylinder chamber (54) and a third compression chamber (63) formed between the inner periphery of the first piston (53) and the inside inner wall of the first cylinder chamber (54). Furthermore, the outer cylindrical part (52*c*) of the first cylinder (52) has a first communication passage (59) formed to communicate the space outside of the first cylinder (52) with the first compression chamber (61).

As shown in FIG. 3, in the first cylinder (52), a blade (45) extends from the inner periphery of the outer cylindrical part (52*c*) to the outer periphery of the inner cylindrical part (52*b*). The blade (45) partitions each of the first compression chamber (61) and the third compression chamber (63) into a low-pressure sub-chamber serving as a suction-side sub-chamber and a high-pressure sub-chamber serving as a discharge-side sub-chamber. On the other hand, the first piston (53) has the shape of the letter C obtained by cutting away part of a ring. The blade (45) is inserted through the cutaway part of the first piston (53). In addition, semi-circular bushes (46, 46) are fitted into the cutaway part of the piston (53) to sandwich the blade (45) therebetween. The bushes (46, 46) are configured to be oscillatable at the ends of the piston (53). Based on the above configuration, the cylinder (52) can move forward and backward in the direction of extension of the blade (45) and can oscillate together with the bushes (46, 46). As the drive shaft (23) rotates, the cylinder (52) eccentrically rotates in order from (A) to (D) in FIG. 3, whereby refrigerant is compressed in the first compression chamber (61) and the third compression chamber (63). During the rotation of the cylinder (52), the first compression chamber (61) and the third compression chamber (63) change their positions while differing in phase from each other by 180° with respect to the axis of the drive shaft (23).

The second compression mechanism (25) is composed of the same mechanical components as those of the first compression mechanism (24) to vertically invert those of the first compression mechanism (24). Specifically, the second compression mechanism (25) includes a second housing (55) fixed to the casing (21) and a second cylinder (56) contained in the second housing (55). Disposed inside the second housing (55) is an annular second piston (57) extending downward. The second cylinder (56) includes a disc-shaped end plate (56*a*), an annular inner cylindrical part (56*b*) extending upward from the inner peripheral end of the end plate (56*a*) and an annular outer cylindrical part (56*c*) extending upward from the outer peripheral end of the end plate (56*a*). The second cylinder (56) is configured to eccentrically rotate about the axis of the second eccentric part (23*b*) with rotation of the drive shaft (23).

Furthermore, the second cylinder (56) has an annular second cylinder chamber (58) defined between the outer periphery of the inner cylindrical part (56*b*) and the inner periphery of the outer cylindrical part (56*c*). Disposed in the second cylinder chamber (58) is the second piston (57). As a result, the second cylinder chamber (58) is partitioned into a second compression chamber (62) formed between the outer periphery of the second piston (57) and the outside inner wall of the second cylinder chamber (58) and a fourth compression chamber (64) formed between the inner periphery of the second piston (57) and the inside inner wall of the second cylinder chamber (58). Furthermore, the outer cylindrical part (56*c*) of the second cylinder (56) has a second communication passage (60) formed to communicate the space outside of the second cylinder (56) with the third compression chamber (63).

In the second compression mechanism (25), like the first compression mechanism (24), the second cylinder (56) eccentrically rotates in the same manner as shown in FIG. 3 as the drive shaft (23) rotates. As a result, refrigerant is compressed in the second compression chamber (62) and the fourth compression chamber (64). The second compression chamber (62) and the fourth compression chamber (64) change their positions while differing in phase from each other by 180° with respect to the axis of the drive shaft (23).

The first compression mechanism (24) is connected to the above-stated first suction pipe (32*a*), first discharge communication pipe (33*a*) and first suction communication pipe (34*a*). The first suction pipe (32*a*) is communicated via the first communication passage (59) with the suction side of the first compression chamber (61). The first discharge communication pipe (33*a*) is communicated with the discharge side of the first compression chamber (61). The first discharge communication pipe (33*a*) is provided with a first discharge valve (65). The first discharge valve (65) is configured to open when the difference between the refrigerant pressure in the discharge side of the first compression chamber (61) and the pressure in the first discharge communication pipe (33*a*) reaches a predetermined pressure or more. The first compression mechanism (24) also includes a discharge port (66) for communicating the discharge side of the third compression chamber (63) with the internal space of the casing (21). The discharge port (66) is provided with a second discharge valve (67). The second discharge valve (67) is configured to open when the difference between the refrigerant pressure in the discharge side of the third compression chamber (63) and the internal pressure of the casing (21) reaches a predetermined pressure or more.

The second compression mechanism (25) is connected to the above-stated second suction pipe (32*b*), second discharge communication pipe (33*b*) and second suction communication pipe (34*b*). The second suction pipe (32*b*) is communicated via the second communication passage (60) with the suction side of the second compression chamber (62). The second discharge communication pipe (33*b*) is communicated with the discharge side of the second compression chamber (62). The second discharge communication pipe (33*b*) is provided with a third discharge valve (68). The third discharge valve (68) is configured to open when the difference between the refrigerant pressure in the discharge side of the second compression chamber (62) and the pressure in the second discharge communication pipe (33*b*) reaches a predetermined pressure or more. The second compression mechanism (25) also includes a discharge port (69) for communicating the discharge side of the fourth compression chamber (64) with the internal space of the casing (21). The discharge port (69) is provided with a fourth discharge valve (70). The fourth discharge valve (70) is configured to open when the difference between the refrigerant pressure in the discharge side of the fourth compression chamber (64) and the internal pressure of the casing (21) reaches a predetermined pressure or more.

The casing (21) for the compressor (20) is connected at the top to a discharge pipe (31) and connected at the peripheral wall to the branch communication pipe (35). The discharge pipe (31) and the branch communication pipe (35) open at their one ends into the internal space of the casing (21).

According to the compressor (20) having the above structure, with rotation of the drive shaft (23), the cylinders (52, 56) of the compression mechanisms (24, 25) eccentrically rotate relative to their respective pistons (53, 57). As a result, the capacities of the compression chambers (61, 63) of the first compression mechanism (24) cyclically change and, concurrently, the capacities of the compression chambers (62, 64) of the second compression mechanism (25) also cyclically change.

In the first compression mechanism (24), during one turn of the drive shaft (23), the angle of rotation at the time of refrigerant discharge from the first compression chamber (61) differs from the angle of rotation at the time of refrigerant discharge from the third compression chamber (63) by 180°. In other words, in the first compression mechanism (24), the capacity changing cycle of the first compression chamber (61) differs in phase from the capacity changing cycle of the third compression chamber (63) by 180°.

In the second compression mechanism (25), during one turn of the drive shaft (23), the angle of rotation at the time of refrigerant discharge from the second compression chamber (62) differs from the angle of rotation at the time of refrigerant discharge from the fourth compression chamber (64) by 180°. In other words, in the second compression mechanism (25), the capacity changing cycle of the second compression chamber (62) differs in phase from the capacity changing cycle of the fourth compression chamber (64) by 180°.

Furthermore, in the compressor (20) of this embodiment, the capacity changing cycles of the first compression chamber (61) and the second compression chamber (62) differ in phase from each other by 180° and the capacity changing cycles of the third compression chamber (63) and the fourth compression chamber (64) also differ in phase from each other by 180°.

-Operational Behavior-

Next, a description is given of the operational behavior of the air conditioner (1) of Embodiment 1. In the air conditioner (1), the following heating operation and cooling operation can be changed in terms of their operating mode.

(Heating Operation)

Figure 4:
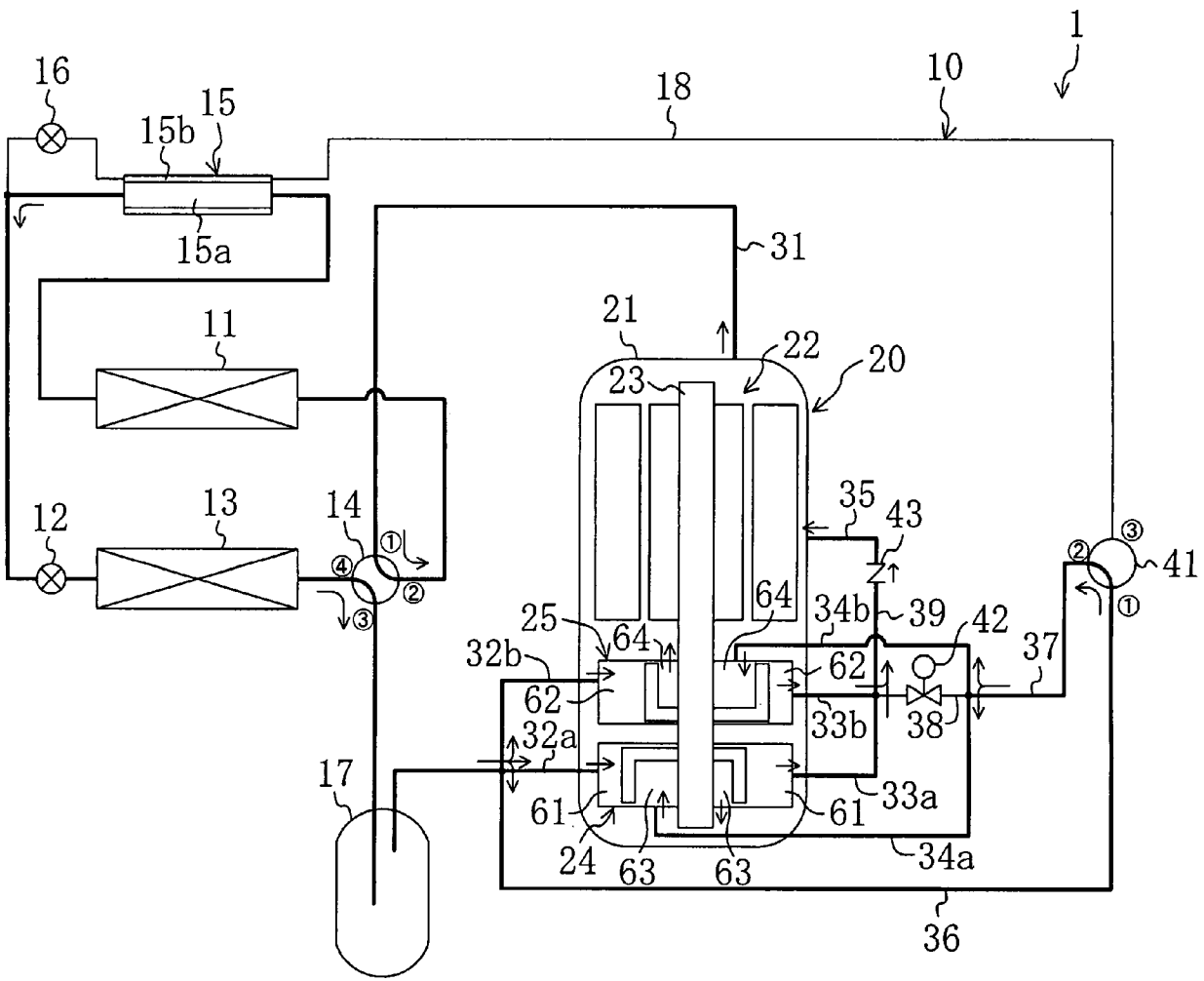
FIG. 4 is a piping diagram illustrating a parallel compression mode during a heating operation.
Figure 5:
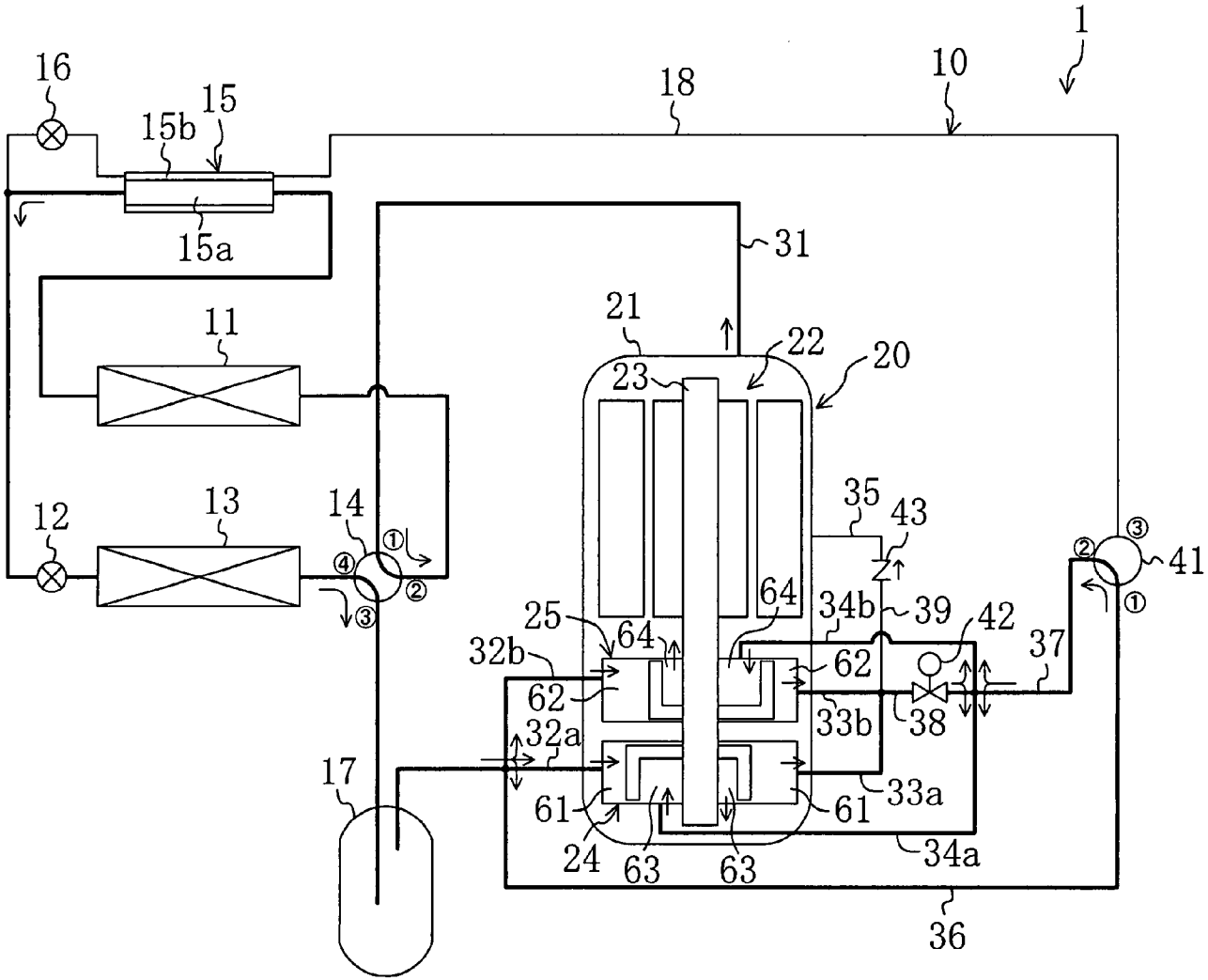
FIG. 5 is a piping diagram illustrating a cylinder nonoperating mode during the heating operation.
Figure 6:
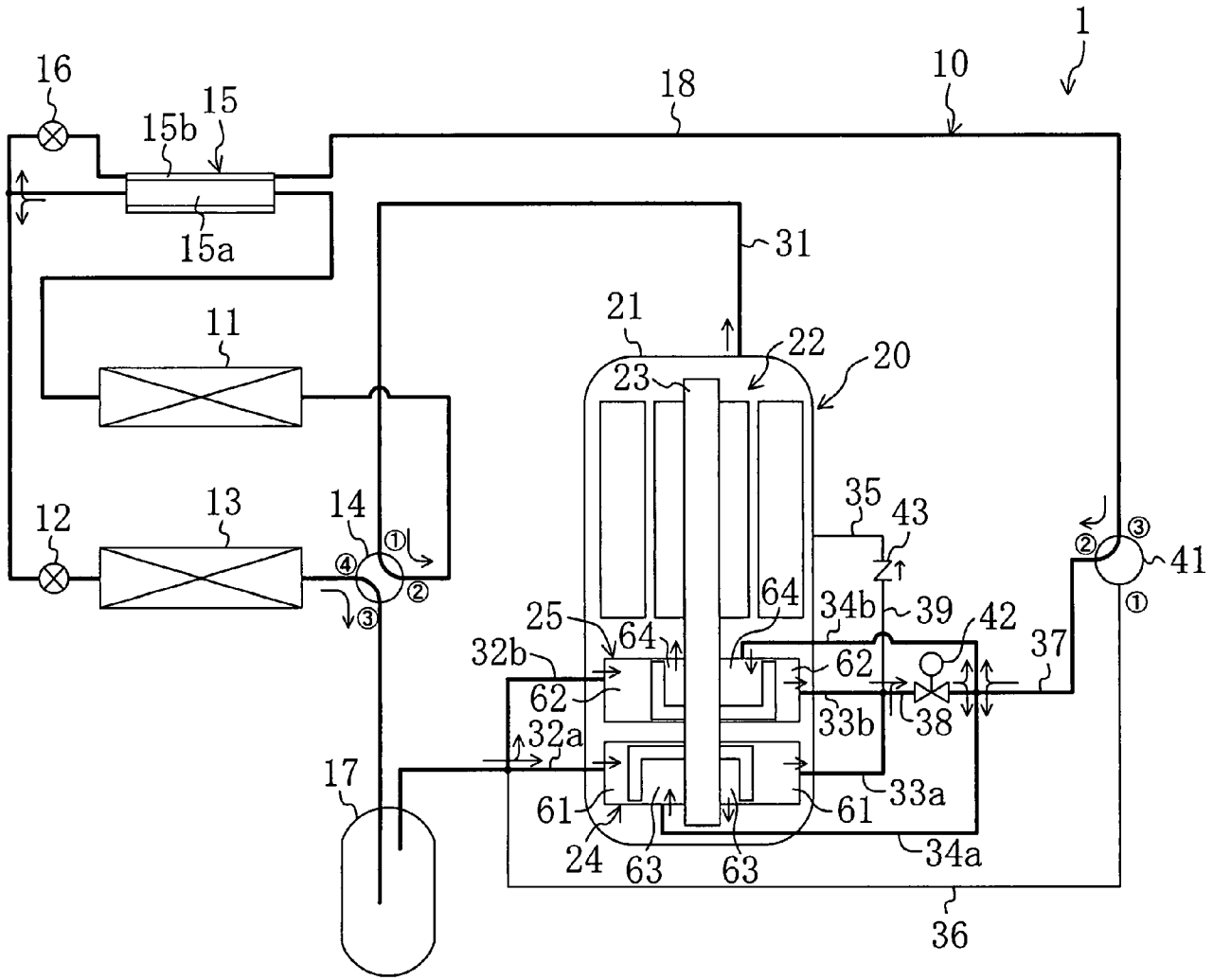
FIG. 6 is a piping diagram illustrating a two-stage compression mode during the heating operation.

In a heating operation of the air conditioner (1), the four-way selector valve (14) is selected to either one of the positions shown in FIGS. 4 to 6 and the opening of the expansion valve (12) is appropriately adjusted. Furthermore, in the heating operation, the compressor (20) can be switched among a parallel compression mode, a cylinder nonoperating mode and a two-stage compression mode by changing the positions of the three-way valve (41) and the solenoid shut-off valve (42).

<<Parallel Compression Mode>>

When during the heating operation the heating load of the room is relatively high and the air conditioner (1) falls short of heating capacity, the compressor (20) operates in the parallel compression mode. In the parallel compression mode, the three-way valve (41) is in the position shown in FIG. 4 and the solenoid shut-off valve (42) of the third bypass pipe (38) is in a closed position. Furthermore, in the parallel compression mode, the opening of the pressure reduction valve (16) is in a closed position.

As shown in FIG. 4, refrigerant discharged from the discharge pipe (31) of the compressor (20) flows via the four-way selector valve (14) through the indoor heat exchanger (11). In the indoor heat exchanger (11), the refrigerant releases heat to room air to condense. As a result, the room space is heated.

The refrigerant having condensed in the indoor heat exchanger (11) flows through the first heat-exchange channel (15*a*) of the internal heat exchanger (15) as it is, is reduced to a low pressure by the expansion valve (12) and then flows through the outdoor heat exchanger (13). In the outdoor heat exchanger (13), the refrigerant takes heat from outdoor air to evaporate. The refrigerant having evaporated in the outdoor heat exchanger (13) is delivered via the liquid receiver (17) to the suction side of the compressor (20).

The refrigerant having flowed towards the suction side of the compressor (20) is distributed to the first suction pipe (32*a*), the second suction pipe (32*b*) and the first bypass pipe (36). The refrigerant having flowed through the first suction pipe (32*a*) is compressed in the first compression chamber (61) of the first compression mechanism (24) and then discharged through the first discharge communication pipe (33*a*) to the outside of the first compression chamber (61). The refrigerant is then delivered via the fourth bypass pipe (39) to the internal space of the casing (21). The refrigerant having flowed through the second suction pipe (32*b*) is compressed in the second compression chamber (62) of the second compression mechanism (25) and then discharged through the second discharge communication pipe (33*b*) to the outside of the second compression chamber (62). The refrigerant is then delivered via the fourth bypass pipe (39) to the internal space of the casing (21). The refrigerant having flowed through the first bypass pipe (36) flows through the second bypass pipe (37) and is then distributed to the first suction communication pipe (34*a*) and the second suction communication pipe (34*b*). The refrigerant having flowed through the first suction communication pipe (34*a*) is compressed in the third compression chamber (63) and then discharged through the discharge port (66) to the internal space of the casing (21). The refrigerant having flowed through the second suction communication pipe (34*b*) is compressed in the fourth compression chamber (64) and then discharged through the discharge port (69) to the internal space of the casing (21).

As described so far, in the parallel compression mode, low-pressure refrigerant is compressed in a single stage in each of the first to fourth compression chambers (61, 62, 63, 64) to provide high-pressure refrigerant. The high-pressure refrigerant is discharged again through the discharge pipe (31) to the outside of the casing (21).

<<Cylinder Nonoperating Mode>>

When during the heating operation the outside temperature is relatively high and the heating load of the room is small, the compressor (20) operates in the cylinder nonoperating mode. In the cylinder nonoperating mode, the three-way valve (41) is in the position shown in FIG. 5 and the solenoid shut-off valve (42) of the third bypass pipe (38) is in an open position. Furthermore, in the cylinder nonoperating mode, the pressure reduction valve (16) is in a closed position.

As shown in FIG. 5, refrigerant discharged from the discharge pipe (31) of the compressor (20) flows via the four-way selector valve (14) through the indoor heat exchanger (11). In the indoor heat exchanger (11), the refrigerant releases heat to room air to condense. As a result, the room space is heated.

The refrigerant having condensed in the indoor heat exchanger (11) flows through the first heat-exchange channel (15*a*) of the internal heat exchanger (15) as it is, is reduced to a low pressure by the expansion valve (12) and then flows through the outdoor heat exchanger (13). In the outdoor heat exchanger (13), the refrigerant takes heat from outdoor air to evaporate. The refrigerant having evaporated in the outdoor heat exchanger (13) is delivered via the liquid receiver (17) to the suction side of the compressor (20).

The refrigerant having flowed towards the suction side of the compressor (20) is distributed to the first suction pipe (32*a*), the second suction pipe (32*b*) and the first bypass pipe (36). The refrigerant having flowed through the first suction pipe (32*a*) is sucked into the first compression chamber (61) of the first compression mechanism (24), while the refrigerant having flowed through the second suction pipe (32*b*) is sucked into the second compression chamber (62) of the second compression mechanism (25). During the cylinder nonoperating mode, the suction and discharge sides of the first compression chamber (61) are communicated with each other through the first bypass pipe (36), the second bypass pipe (37), the third bypass pipe (38) and the first discharge communication pipe (33*a*). Furthermore, the suction and discharge sides of the second compression chamber (62) are communicated with each other through the first bypass pipe (36), the second bypass pipe (37), the third bypass pipe (38) and the second discharge communication pipe (33*b*). Thus, in the cylinder nonoperating mode, the pressures in the suction and discharge sides of the first compression chamber (61) are equalized to each other and the pressures in the suction and discharge sides of the second compression chamber (62) are also equalized to each other. Therefore, in the first compression chamber (61), the first discharge valve (65) is always open since the pressure in the discharge side is small. In the second compression chamber (62), the third discharge valve (68) is always open since the pressure in the discharge side is small. Accordingly, in the first compression chamber (61), refrigerant flows out through the open first discharge valve (65) to the first discharge communication pipe (33*a*) as it remains uncompressed. In the second compression chamber (62), refrigerant flows out through the open third discharge valve (68) to the second discharge communication pipe (33*b*) as it remains uncompressed. In other words, in the first compression chamber (61) and the second compression chamber (62) during the cylinder nonoperating mode, the work of compressing refrigerant is not done and refrigerant passes through the compression chambers (61, 63) as it is.

The refrigerant having flowed out of the first discharge communication pipe (33*a*) and the second discharge communication pipe (33*b*) flows through the third bypass pipe (38) and is then distributed to the first suction communication pipe (34*a*) and the second suction communication pipe (34*b*). The refrigerant having flowed through the first suction communication pipe (34*a*) is compressed in the third compression chamber (63) and then discharged through the discharge port (66) to the internal space of the casing (21). The refrigerant having flowed through the second suction communication pipe (34*b*) is compressed in the fourth compression chamber (64) and then discharged through the discharge port (69) to the internal space of the casing (21).

As described so far, in the cylinder nonoperating mode, the refrigerant compression operation is halted in the first compression chamber (61) and the second compression chamber (62) while low-pressure refrigerant is compressed in a single stage in each of the third compression chamber (63) and the fourth compression chamber (64) to provide high-pressure refrigerant. The high-pressure refrigerant is discharged again through the discharge pipe (31) to the outside of the casing (21).

<<Two-Stage Compression Mode>>

When during the heating operation the outside temperature is very low, the compressor (20) operates in the two-stage compression mode. In the two-stage compression mode, the three-way valve (41) is in the position shown in FIG. 6 and the solenoid shut-off valve (42) of the third bypass pipe (38) is in an open position. Furthermore, in the two-stage compression mode, the opening of the pressure reduction valve (16) is appropriately adjusted.

As shown in FIG. 6, refrigerant discharged from the discharge pipe (31) of the compressor (20) flows via the four-way selector valve (14) through the indoor heat exchanger (11). In the indoor heat exchanger (11), the refrigerant releases heat to room air to condense. As a result, the room space is heated.

The refrigerant having condensed in the indoor heat exchanger (11) flows through the first heat-exchange channel (15*a*) of the internal heat exchanger (15). In the internal heat exchanger (15), the refrigerant distributed to the intermediate injection pipe (18) and reduced to an intermediate pressure by the pressure reduction valve (16) flows through the second heat-exchange channel (15*b*). In short, in the internal heat exchanger (15), high-pressure refrigerant flows through the first heat-exchange channel (15*a*) while intermediate-pressure refrigerant flows through the second heat-exchange channel (15*b*). Therefore, in the internal heat exchanger (15), heat of refrigerant in the first heat-exchange channel (15*a*) is applied to refrigerant in the second heat-exchange channel (15*b*), whereby the refrigerant in the second heat-exchange channel (15*b*) evaporates.

On the other hand, the remaining refrigerant not distributed to the intermediate injection pipe (18) is reduced to a low pressure by the expansion valve (12) and then flows through the outdoor heat exchanger (13). In the outdoor heat exchanger (13), the refrigerant takes heat from outdoor air to evaporate. The refrigerant having evaporated in the outdoor heat exchanger (13) is delivered via the liquid receiver (17) to the suction side of the compressor (20).

The refrigerant delivered towards the suction side of the compressor (20) is distributed to the first suction pipe (32*a*) and the second suction pipe (32*b*). The refrigerant having flowed through the first suction pipe (32*a*) is compressed in the first compression chamber (61) of the first compression mechanism (24) and then discharged through the first discharge communication pipe (33*a*) to the outside of the first compression chamber (61). The refrigerant having flowed through the second suction pipe (32*b*) is compressed in the second compression chamber (62) of the second compression mechanism (25) and then discharged through the second discharge communication pipe (33*b*) to the outside of the second compression chamber (62). The refrigerant flows discharged from both the discharge communication pipes (33*a*, 33*b*) combine with each other at the third bypass pipe (38).

As described above, the refrigerant having evaporated in the internal heat exchanger (15) flows through the intermediate injection pipe (18). Therefore, the refrigerant flows through the three-way valve (41) and the second bypass pipe (37) and then combine with the refrigerant having flowed through the third bypass pipe (38). As described so far, in the two-stage compression mode, the refrigerant after compressed in the first compression chamber (61) and the second compression chamber (62) is combined with intermediate-pressure refrigerant through the intermediate injection pipe (18), whereby the temperature of refrigerant discharged from the first compression mechanism (24) is reduced.

The combined refrigerant is distributed to the first suction communication pipe (34*a*) and the second suction communication pipe (34*b*). The refrigerant having flowed through the first suction communication pipe (34*a*) is further compressed in the third compression chamber (63) and then discharged through the discharge port (66) to the internal space of the casing (21). The refrigerant having flowed through the second suction communication pipe (34*b*) is further compressed in the fourth compression chamber (64) and then discharged through the discharge port (69) to the internal space of the casing (21).

As described so far, in the two-stage compression mode, the refrigerant compressed to an intermediate pressure in the first compression chamber (61) and the second compression chamber (62) is further compressed in the third compression chamber (63) and the fourth compression chamber (64) to provide high-pressure refrigerant. The high-pressure refrigerant is discharged again through the discharge pipe (31) to the outside of the casing (21).

(Cooling Operation)

Figure 7:
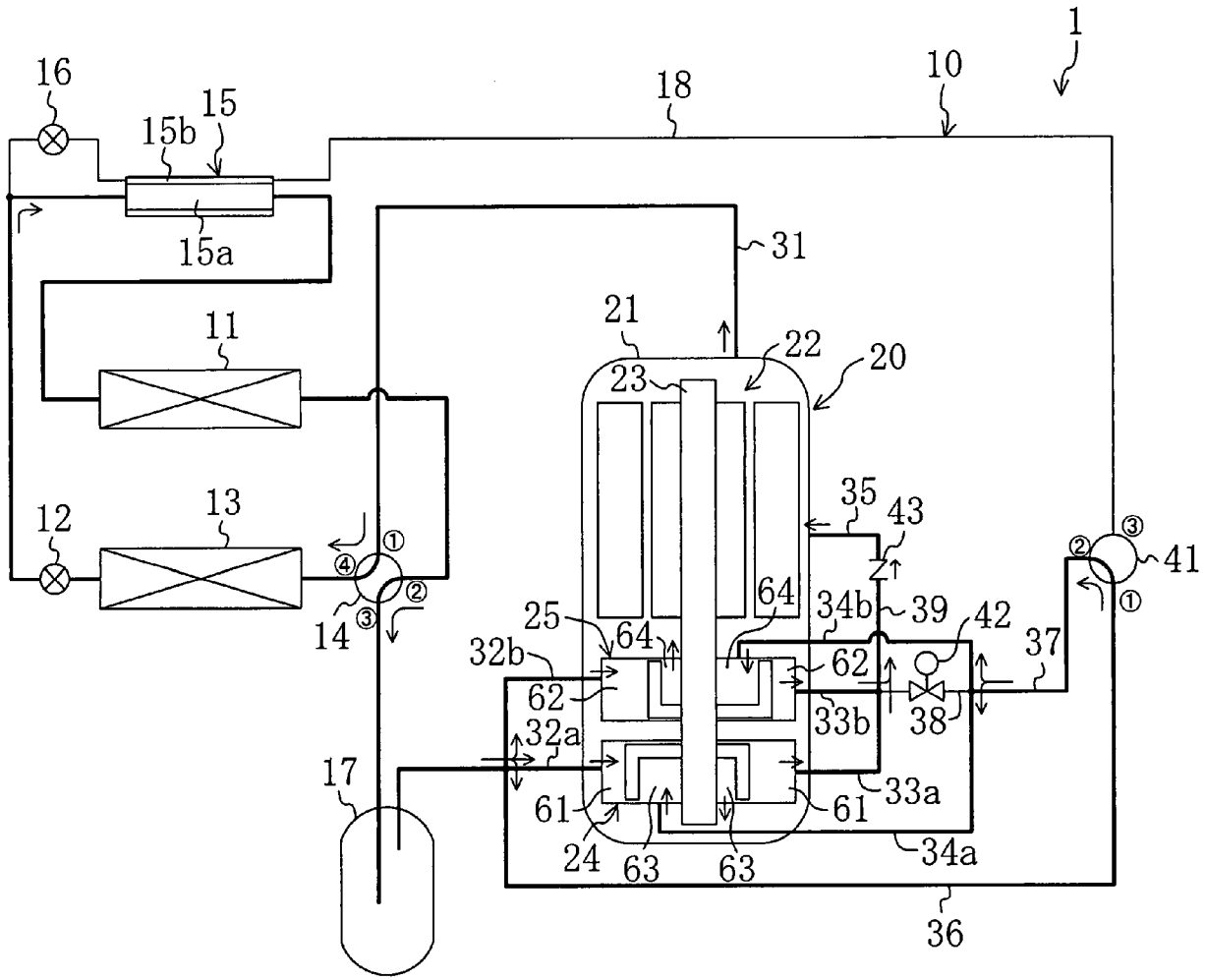
FIG. 7 is a piping diagram illustrating a parallel compression mode during a cooling operation.

In a cooling operation of the air conditioner (1), the four-way selector valve (14) is selected to the position shown in FIG. 7 and the opening of the expansion valve (12) is appropriately adjusted. Furthermore, in the cooling operation, the compressor (20) can be switched between such a parallel compression mode and a cylinder nonoperating mode as stated above by changing the positions of the three-way valve (41) and the solenoid shut-off valve (42). A description is given here only of the parallel compression mode during the cooling operation.

High-pressure refrigerant discharged from the discharge pipe (31) of the compressor (20) flows via the four-way selector valve (14) through the outdoor heat exchanger (13). In the outdoor heat exchanger (13), refrigerant releases heat to outdoor air to condense. The refrigerant having condensed in the outdoor heat exchanger (13) is reduced in pressure by the expansion valve (12) and then flows through the indoor heat exchanger (11). In the indoor heat exchanger (11), the refrigerant takes heat from room air to evaporate. As a result, the room space is cooled. The refrigerant having evaporated in the indoor heat exchanger (11) is delivered via the liquid receiver (17) to the suction side of the compressor (20).

The compressor (20) operates in the parallel compression mode in the same manner as described previously. Specifically, the refrigerant sucked into the compressor (20) is compressed in a single stage in each of the compression chambers (61, 62, 63, 64). The refrigerant compressed in each of the compression chambers (61, 62, 63, 64) is discharged again from the internal space of the casing (21) to the discharge pipe (31).

<Evaluation of Compression Torque>

When conventional twin-cylinder compressors operate in the parallel compression mode, cylinder nonoperating mode and two-stage compression mode as stated above, the compression torques of their drive shafts are likely to change owing to refrigerant compression operation in each compression chamber. Specifically, when such a conventional twin-cylinder compressor operates in the cylinder nonoperating mode by halting the refrigerant compression operation in one of the two compression chambers, the refrigerant pressure in the other compression chamber largely changes during one turn of the drive shaft, which is likely to cause a significant change in compression torque (see, for example, the broken line in 7). Furthermore, also when such a twin-cylinder compressor operates in the two-stage compression mode, the refrigerant pressure in the low-pressure stage compression chamber of relatively high compression ratio is likely to change, which is likely to invite increased compression torque. Therefore, the conventional twin-cylinder compressors cause a problem that in the cylinder nonoperating mode and the two-stage compression mode, vibration and noise are increased owing to change in compression torque. In addition, such operations in the two-stage compression mode and the cylinder nonoperating mode are often carried out while the drive shaft is at low rotational speeds. It is generally known that when a compressor is driven at low speed like this, vibration and noise are likely to increase. Therefore, in the two-stage compression mode and cylinder nonoperating mode in which the drive shaft is often at low rotational speeds, it is particularly necessary to reduce the change in compression torque. To reduce the change in compression torque in the two-stage compression mode and the cylinder nonoperating mode, the compressor (20) of this embodiment is provided with two pairs of compression chambers in which each pair of compression chambers have different phases of capacity changing cycle.

Figure 8:
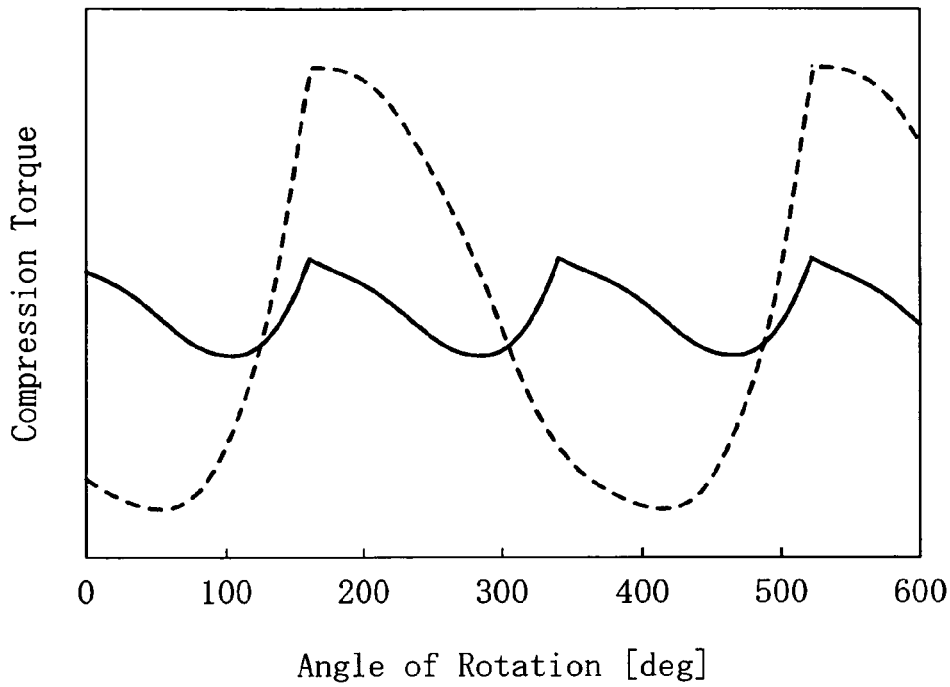
FIG. 8 is a graph showing the relationship between compression torque and angle of rotation of a drive shaft.

Specifically, the compressor (20) of this embodiment compresses refrigerant, in the cylinder nonoperating mode, in the third compression chamber (63) and the fourth compression chamber (64) that differ in the phase of capacity changing cycle from each other by 180°. Therefore, in the compressor (20) of this embodiment, the phase at the maximum refrigerant pressure in the third compression chamber (63) differs from the phase at the maximum refrigerant pressure in the fourth compression chamber (64) by 180°. As a result, as shown in the solid line in FIG. 8, the variation band of compression torque during one turn of the drive shaft (23) is smoothed. Thus, the compression torque in the cylinder nonoperating mode can be reduced as compared to the twin-cylinder compressors.

Furthermore, also in the two-stage compression mode of the compressor (20) of this embodiment, the first compression chamber (61) and second compression chamber (62) both of which are low-pressure stage compression chambers differ in the phase of capacity changing cycle from each other by 180°. Therefore, the phase at the maximum refrigerant pressure in the first compression chamber (61) differs from the phase at the maximum refrigerant pressure in the second compression chamber (62) by 180°. Thus, the behavior of compression torque due to refrigerant compression operations in the first compression chamber (61) and second compression chamber (62) is the same as that in the cylinder nonoperating mode shown in FIG. 8. As a result, the change in compression torque in the two-stage compression mode can be reduced as compared to the twin-cylinder compressors.

Furthermore, in the parallel compression mode of the compressor (20) of this embodiment, refrigerant is compressed in each chamber of the two pairs of compression chambers (61, 62, 63, 64) in which each pair of compression chambers differ in the phase of capacity changing cycle from each other by 180°. Therefore, during one turn of the drive shaft (23), the first compression chamber (61) and the second compression chamber (62) differ in the phase at the maximum refrigerant pressure from each other by 180° and the third compression chamber (63) and the fourth compression chamber (64) also differ in the phase at the maximum refrigerant pressure from each other by 180°. As a result, the compression torque of the drive shaft (23) is smoothed, whereby the change in compression torque in the parallel compression mode can be reduced as compared to the twin-cylinder compressors.

-Effects of Embodiment 1-

As described previously, in Embodiment 1, the compressor (20) includes a first compression mechanism (24) having two compression chambers (61, 63) and a second compression mechanism (25) having two compression chambers (62, 64), wherein the first compression chamber (61) and the second compression chamber (62) differ in the phase of capacity changing cycle from each other by 180° and the third compression chamber (63) and the fourth compression chamber (64) also differ in the phase of capacity changing cycle from each other by 180°.

Therefore, in the cylinder nonoperating mode, the third compression chamber (63) and the fourth compression chamber (63) can be made different in the phase of changing cycle of refrigerant pressure from each other by 180°, thereby reducing the change in compression torque in the cylinder nonoperating mode. Hence, in the cylinder nonoperating mode that is relatively likely to invite increased vibration and noise, the compression torque can be effectively reduced, thereby providing reduced vibration and reduced noise of the compressor (20).

Furthermore, also in the two-stage compression mode of Embodiment 1, the first compression chamber (61) and second compression chamber (62) both of which are low-pressure stage compression chambers can be made different in the phase of changing cycle of refrigerant pressure from each other by 180°. Therefore, the compression torque in the two-stage compression mode can be effectively reduced.

Furthermore, in Embodiment 1, the first cylinder (52) and the second cylinder (56) both driven by the drive shaft (23) differ in phase from each other by 180° with respect to the drive shaft (23). Therefore, during operation of the compressor (20), the centrifugal forces acting on both the cylinders (52, 56) can be canceled out each other, whereby the vibration and noise of the compressor (20) can be further effectively reduced.

Note that the two compression mechanisms (24, 25) of Embodiment 1 are configured so that the cylinders (52, 56) having annular cylinder chambers (54, 58) eccentrically rotate relative to their respective annular pistons (53, 57). Alternatively, for example, the compression mechanisms (24, 25) may be configured so that the annular pistons (53, 57) are connected, such as through their end plates, to the drive shaft (23), the cylinders (52, 56) are fixed, such as to their housings, and the pistons (53, 57) eccentrically rotate with respect to their respective cylinders (52, 56).

Furthermore, in Embodiment 1, the spaces outside of the pistons (53, 57) provide the first compression chamber (61) and the second compression chamber (62) and the spaces inside of the pistons (53, 57) provide the third compression chamber (63) and the fourth compression chamber (64). However, contrariwise, the spaces inside of the pistons (53, 57) may provide the first compression chamber (61) and the second compression chamber (62) and the spaces outside of the pistons (53, 57) may provide the third compression chamber (63) and the fourth compression chamber (64).

<<Embodiment 2>>

Figure 9:
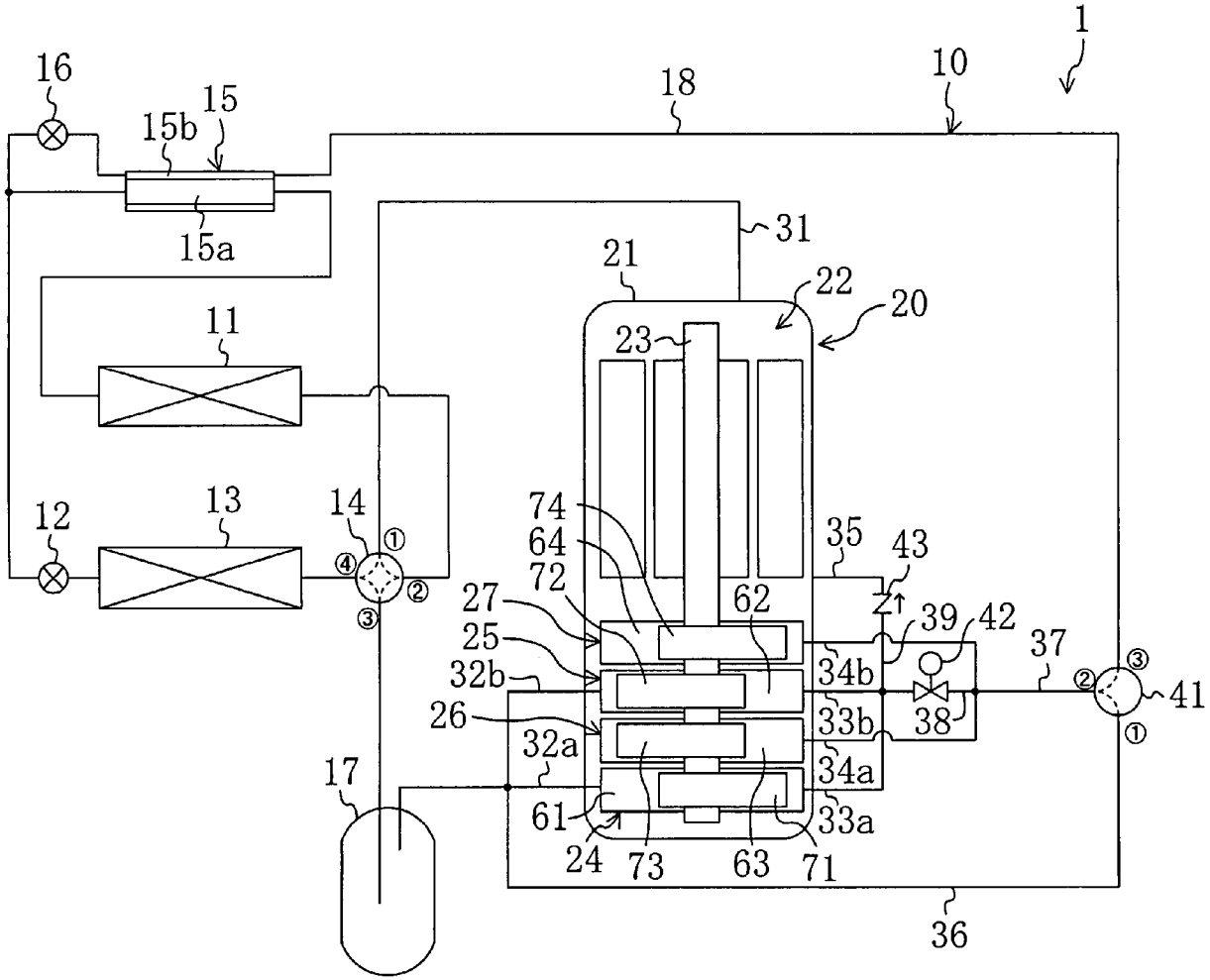
FIG. 9 is a piping diagram of a refrigerant circuit of an air conditioner according to Embodiment 2.

An air conditioner (1) of Embodiment 2 is different from that of Embodiment 1 in the structure of the compressor (20). As shown in FIG. 9, the compressor main unit (30) of the compressor (20) in Embodiment 2 includes first to fourth compression mechanisms (24, 25, 26, 27).

Figure 10:
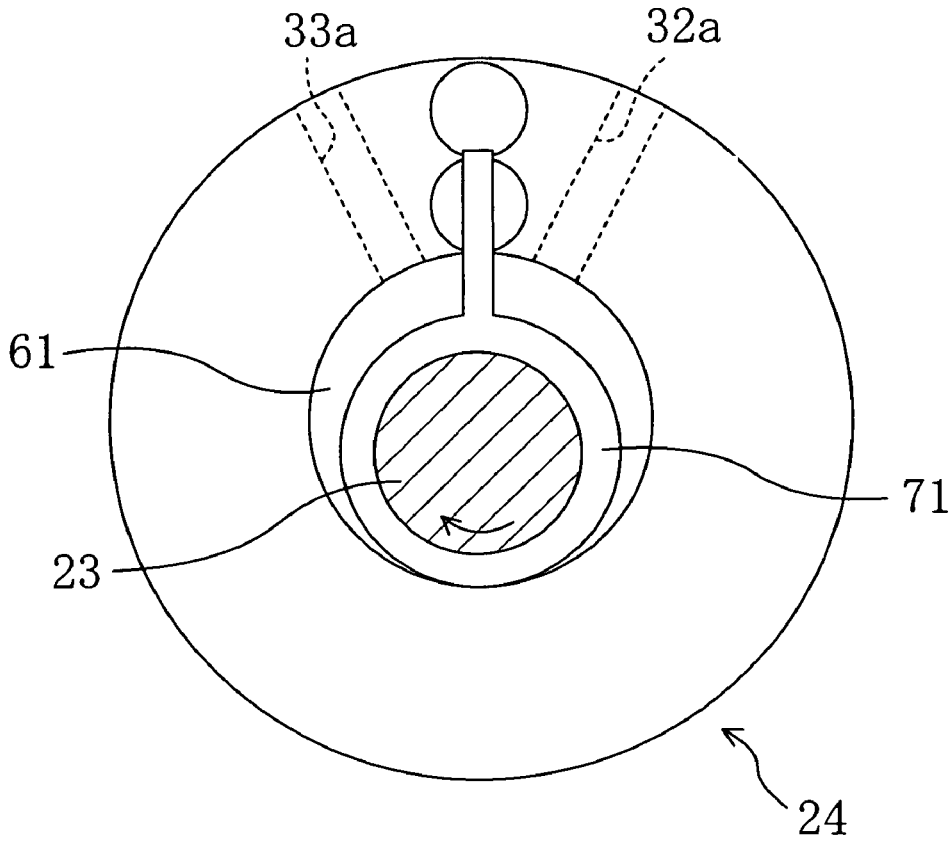
FIG. 10 is a transverse cross-sectional view of a first compression mechanism.

The drive shaft (23) is provided, in order from its lower end upward, with a first compression mechanism (24), a third compression mechanism (26), a second compression mechanism (25) and a fourth compression mechanism (27). Each of the compression mechanisms (24, 25, 26, 27), as shown in FIG. 10, constitutes a rolling piston rotary compression mechanism.

In the first compression mechanism (24), a first piston (71) is contained in its cylinder chamber. The first compression mechanism (24) has a first compression chamber (61) formed to cyclically change its capacity according to eccentric rotation of the first piston (71). In the second compression mechanism (25), a second piston (72) is contained in its cylinder chamber. The second compression mechanism (25) has a second compression chamber (62) formed to cyclically change its capacity according to eccentric rotation of the second piston (72). In the third compression mechanism (26), a third piston (73) is contained in its cylinder chamber. The third compression mechanism (26) has a third compression chamber (63) formed to cyclically change its capacity according to eccentric rotation of the third piston (73). In the fourth compression mechanism (27), a fourth piston (74) is contained in its cylinder chamber. The fourth compression mechanism (27) has a fourth compression chamber (64) formed to cyclically change its capacity according to eccentric rotation of the fourth piston (74).

The suction side of the first compression chamber (61) is connected to a first suction pipe (32*a*), while the suction side of the second compression chamber (62) is connected to a second suction pipe (32*b*). On the other hand, the discharge side of the first compression chamber (61) is connected to a first discharge communication pipe (33*a*), while the discharge side of the second compression chamber (62) is connected to a second discharge communication pipe (33*b*). The first discharge communication pipe (33*a*) and the second discharge communication pipe (33*b*) are provided with their respective unshown discharge valves.

The suction side of the third compression chamber (63) is connected to a first suction communication pipe (34*a*), while the suction side of the fourth compression chamber (64) is connected to a second suction communication pipe (34*b*). Furthermore, the discharge sides of the third compression chamber (63) and the fourth compression chamber (64) are provided with their respective discharge ports opening into the internal space of the casing (21) and their respective discharge valves for opening and closing the associated discharge ports (where these elements are not given in the figures).

In the compressor (20) of Embodiment 2, the first piston (71) and the second piston (72) differ in phase from each other by 180° with respect to the drive shaft (23) and the third piston (73) and the fourth piston (74) differ in phase from each other by 180° with respect to the drive shaft (23). Thus, in the compressor (20), the first compression chamber (61) and the second compression chamber (62) differ in the phase of capacity changing cycle from each other by 180° and the third compression chamber (63) and the fourth compression chamber (64) differ in the phase of capacity changing cycle from each other by 180°.

Furthermore, in the compressor (20), the first piston (71) and the third piston (73) differ in phase from each other by 180° with respect to the drive shaft (23) and the second piston (72) and the fourth piston (74) differ in phase from each other by 180° with respect to the drive shaft (23). Thus, in the compressor (20), the first compression chamber (61) and the third compression chamber (63) also differ in the phase of capacity changing cycle from each other by 180° and the second compression chamber (62) and the fourth compression chamber (64) also differ in the phase of capacity changing cycle from each other by 180°.

-Operational Behavior-

Next, a description is given of the operational behavior of the air conditioner (1) of Embodiment 2. In the air conditioner (1), like Embodiment 1, its heating operation and cooling operation can be changed in terms of their operating mode. A description is given here only of the operational behavior of the air conditioner (1) during the heating operation.

Figure 11:
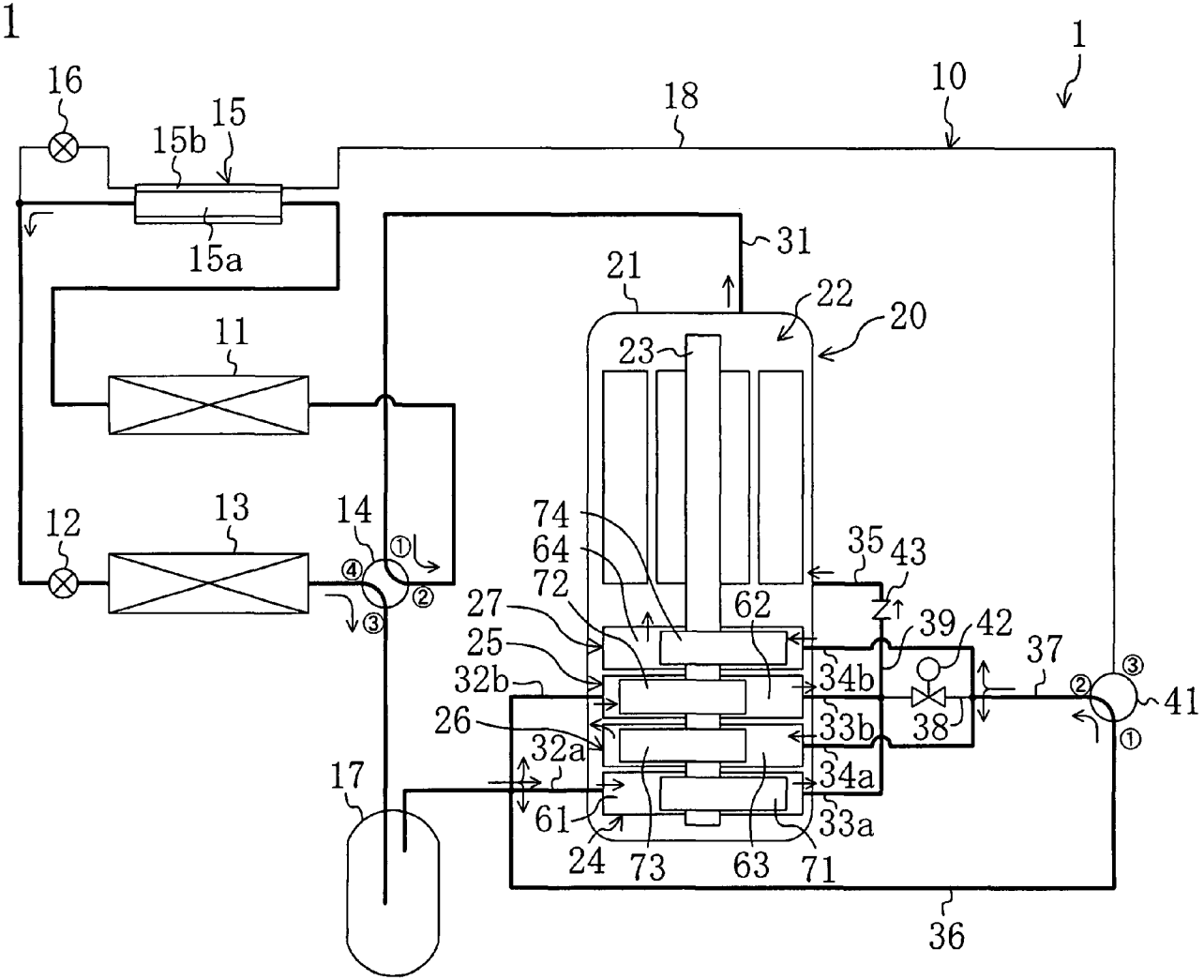
FIG. 11 is a piping diagram illustrating a parallel compression mode during a heating operation.
Figure 12:
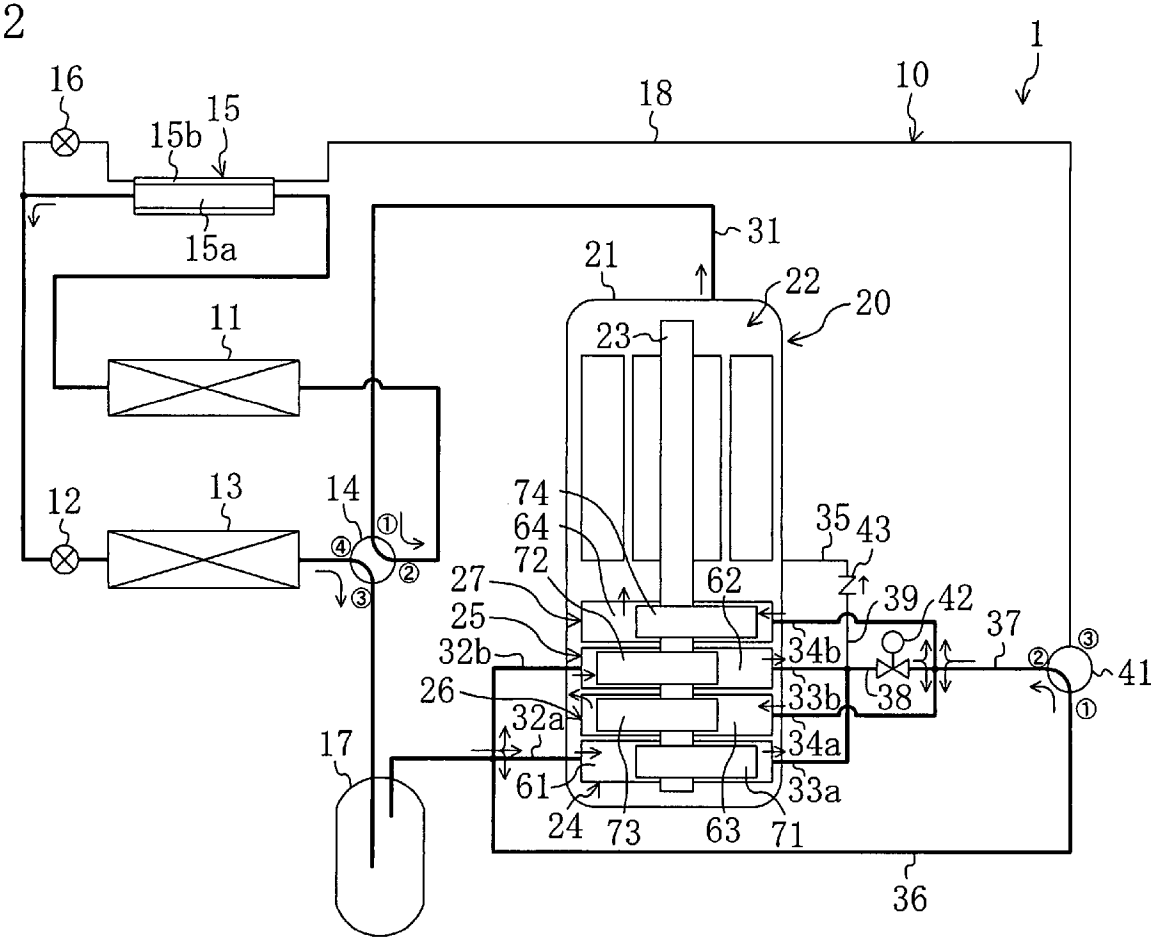
FIG. 12 is a piping diagram illustrating a two-stage compression mode during the heating operation.
Figure 13:
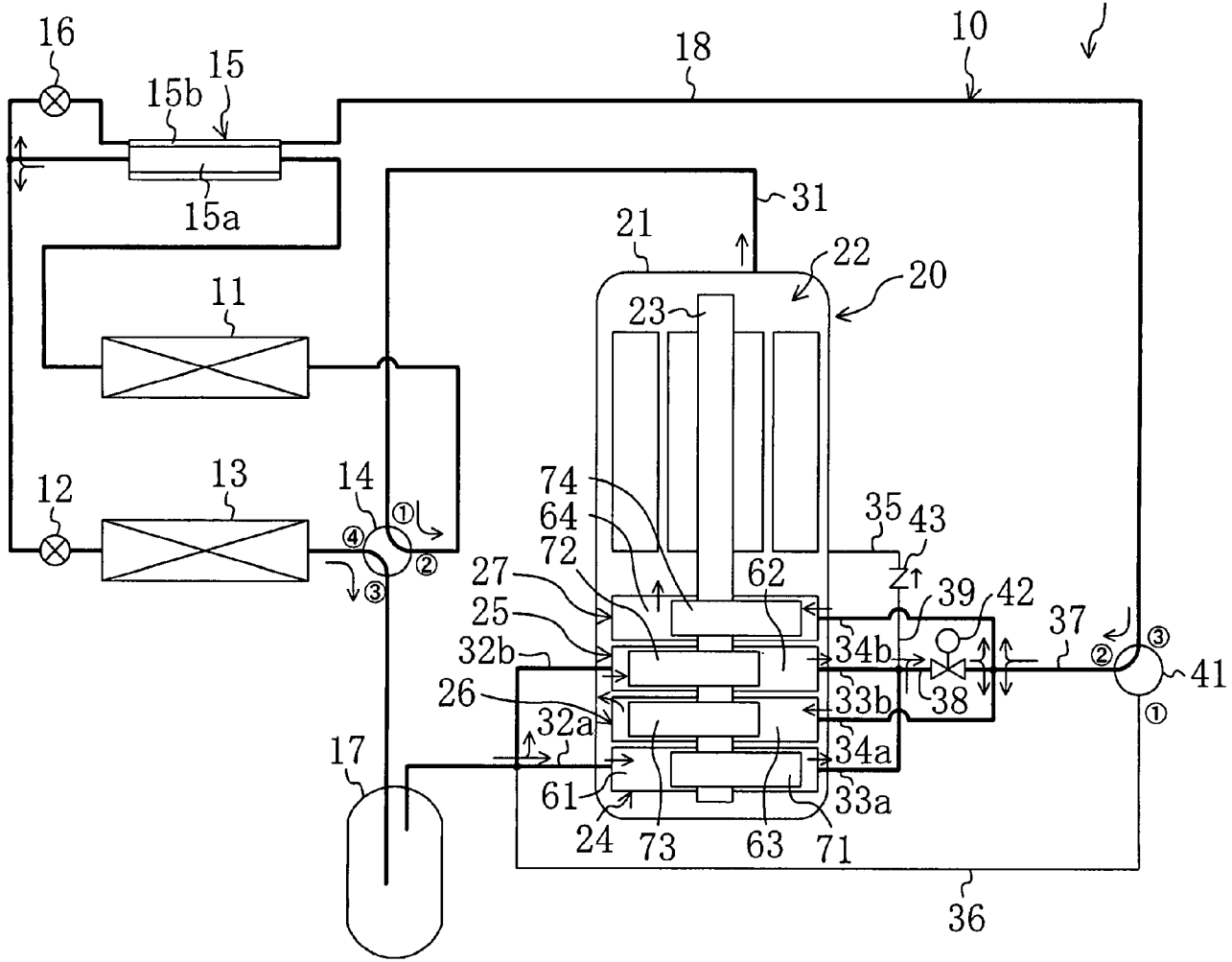
FIG. 13 is a piping diagram illustrating a two-stage compression mode during the heating operation.

In the heating operation of the air conditioner (1), the four-way selector valve (14) is selected to either one of the positions shown in FIGS. 11 to 13 and the opening of the expansion valve (12) is appropriately adjusted. Furthermore, also in the heating operation of the air conditioner (1) of Embodiment 2, the compressor (20) can be switched among a parallel compression mode, a cylinder nonoperating mode and a two-stage compression mode by changing the positions of the three-way valve (41) and the solenoid shut-off valve (42).

<<Parallel Compression Mode>>

In the parallel compression mode, the three-way valve (41) is in the position shown in FIG. 11 and the solenoid shut-off valve (42) of the third bypass pipe (38) is in a closed position. Furthermore, in the parallel compression mode, the opening of the pressure reduction valve (16) is in a closed position. Refrigerant discharged from the compressor (20), like the parallel compression mode in Embodiment 1, flows through the indoor heat exchanger (11) and the outdoor heat exchanger (13) and is then delivered to the suction side of the compressor (20).

The refrigerant having flowed towards the suction side of the compressor (20) is distributed to the first suction pipe (32*a*), the second suction pipe (32*b*) and the first bypass pipe (36). The refrigerant having flowed through the first suction pipe (32*a*) is compressed in the first compression chamber (61) of the first compression mechanism (24) and then discharged through the first discharge communication pipe (33*a*) to the outside of the first compression chamber (61). The refrigerant is delivered via the fourth bypass pipe (39) to the internal space of the casing (21). The refrigerant having flowed through the second suction pipe (32*b*) is compressed in the second compression chamber (62) of the second compression mechanism (25) and then discharged through the second discharge communication pipe (33*b*) to the outside of the second compression chamber (62). The refrigerant is delivered via the fourth bypass pipe (39) to the internal space of the casing (21). The refrigerant having flowed through the first bypass pipe (36) flows through the second bypass pipe (37) and is then distributed to the first suction communication pipe (34*a*) and the second suction communication pipe (34*b*). The refrigerant having flowed through the first suction communication pipe (34*a*) is compressed in the third compression chamber (63) of the third compression mechanism (26) and then discharged through the discharge port to the internal space of the casing (21). The refrigerant having flowed through the second suction communication pipe (34*b*) is compressed in the fourth compression chamber (64) of the fourth compression mechanism (27) and then discharged through the discharge port to the internal space of the casing (21).

<<Cylinder Nonoperating Mode>>

In the cylinder nonoperating mode, the three-way valve (41) is in the position shown in FIG. 12 and the solenoid shut-off valve (42) of the third bypass pipe (38) is in an open position. Furthermore, in the cylinder nonoperating mode, the pressure reduction valve (16) is in a closed position. Refrigerant discharged from the compressor (20), like the cylinder nonoperating mode in Embodiment 1, flows through the indoor heat exchanger (11) and the outdoor heat exchanger (13) and is then delivered to the suction side of the compressor (20).

The refrigerant having flowed towards the suction side of the compressor (20) is distributed to the first suction pipe (32*a*), the second suction pipe (32*b*) and the first bypass pipe (36). The refrigerant having flowed through the first suction pipe (32*a*) is sucked into the first compression chamber (61) of the first compression mechanism (24), while the refrigerant having flowed through the second suction pipe (32*b*) is sucked into the second compression chamber (62) of the second compression mechanism (25). During the cylinder nonoperating mode, like Embodiment 1, the suction and discharge sides of the first compression chamber (61) are communicated with each other and the suction and discharge sides of the second compression chamber (62) are communicated with each other. Therefore, the discharge valves provided at the first discharge communication pipe (33*a*) and the second discharge communication pipe (33*b*) are always open, whereby refrigerant compression operation is not performed in the first compression chamber (61) and the second compression chamber (62).

The refrigerant having flowed out of the first discharge communication pipe (33*a*) and the second discharge communication pipe (33*b*) flows through the third bypass pipe (38) and is then distributed to the first suction communication pipe (34*a*) and the second suction communication pipe (34*b*). The refrigerant having flowed through the first suction communication pipe (34*a*) is compressed in the third compression chamber (63) of the third compression mechanism (26) and then discharged through the discharge port to the internal space of the casing (21). The refrigerant having flowed through the second suction communication pipe (34*b*) is compressed in the fourth compression chamber (64) of the fourth compression mechanism (27) and then discharged through the discharge port to the internal space of the casing (21).

<<Two-Stage Compression Mode>>

In the two-stage compression mode, the three-way valve (41) is in the position shown in FIG. 13 and the solenoid shut-off valve (42) of the third bypass pipe (38) is in an open position. Furthermore, in the two-stage compression mode, the opening of the pressure reduction valve (16) is appropriately adjusted. Refrigerant discharged from the compressor (20), like the two-stage compression mode in Embodiment 1, flows through the indoor heat exchanger (11) and the outdoor heat exchanger (13) and is then delivered to the suction side of the compressor (20).

The refrigerant delivered towards the suction side of the compressor (20) is distributed to the first suction pipe (32*a*) and the second suction pipe (32*b*). The refrigerant having flowed through the first suction pipe (32*a*) is compressed in the first compression chamber (61) of the first compression mechanism (24) and then discharged through the first discharge communication pipe (33*a*) to the outside of the first compression chamber (61). The refrigerant having flowed through the second suction pipe (32*b*) is compressed in the second compression chamber (62) of the second compression mechanism (25) and then discharged through the second discharge communication pipe (33*b*) to the outside of the second compression chamber (62). The refrigerant flows discharged from both the discharge communication pipes (33*a*, 33*b*) combine with each other at the third bypass pipe (38). The combined refrigerant is further combined with intermediate-pressure refrigerant coming from the intermediate injection pipe (18).

The combined refrigerant is distributed to the first suction communication pipe (34*a*) and the second suction communication pipe (34*b*). The refrigerant having flowed through the first suction communication pipe (34*a*) is further compressed in the third compression chamber (63) of the third compression mechanism (26) and then discharged through the discharge port (66) to the internal space of the casing (21). The refrigerant having flowed through the second suction communication pipe (34*b*) is further compressed in the fourth compression chamber (64) of the fourth compression mechanism (27) and then discharged through the discharge port to the internal space of the casing (21).

-Effects of Embodiment 2-

As described previously, in Embodiment 2, the compressor (20) includes first to fourth compression mechanisms (24, 25, 26, 27) each having one compression chamber (61, 62, 63, 64), wherein the first compression chamber (61) and the second compression chamber (62) differ in the phase of capacity changing cycle from each other by 180° and the third compression chamber (63) and the fourth compression chamber (64) also differ in the phase of capacity changing cycle from each other by 180°.

Therefore, like Embodiment 1, in the cylinder nonoperating mode, the phase at the maximum refrigerant pressure in the third compression chamber (63) and the phase at the maximum refrigerant pressure in the fourth compression chamber (64) can be made different from each other by 180°, thereby reducing the compression torque in the cylinder nonoperating mode. Furthermore, also in the two-stage compression mode of Embodiment 2, the phase at the maximum refrigerant pressure in the first compression chamber (61) and the phase at the maximum refrigerant pressure in the second compression chamber (62) can be made different from each other by 180°, thereby effectively reducing the compression torque in the two-stage compression mode.

Furthermore, in Embodiment 2, the first piston (71) and the third piston (73) differ in phase from each other by 180° with respect to the drive shaft (23) and the second piston (72) and the fourth piston (74) differ in phase from each other by 180° with respect to the drive shaft (23). Therefore, the centrifugal forces of the first piston (71) and the third piston (73) can be canceled out each other and the centrifugal forces of the second piston (72) and the fourth piston (74) can be canceled out each other. Hence, the compression torque of the drive shaft (23) can be further reduced, thereby providing reduced noise and reduced vibration of the compressor (20).

Alternatively, the centrifugal forces of the first to fourth pistons (71, 72, 73, 74) may be canceled out by configuring the pistons so that the first piston (71) and the fourth piston (74) differ in phase from each other by 180° and the second piston (72) and the third piston (73) differ in phase from each other by 180°. Also in this case, the first compression chamber (61) and the second compression chamber (62) differ in the phase of capacity changing cycle from each other by 180° and the third compression chamber (63) and the fourth compression chamber (64) differ in the phase of capacity changing cycle from each other by 180°, whereby the compression torque in each compression mode can be reduced.

<<Other Embodiments>>

Each of the above embodiments may have the following configurations. The compressor (20) in each of the above embodiments can be switched among a parallel compression mode, a cylinder nonoperating mode and a two-stage compression mode. However, the refrigeration system may be configured to be switchable between any two of the above three modes.

In each of the above embodiments, the compression mechanisms for the compressor (20) are constituted by compression mechanisms in which annular pistons eccentrically rotate or rolling piston rotary compression mechanisms. However, instead of these compression mechanisms, rotary piston compression mechanisms or other types of compression mechanisms may be used.

The refrigeration system of each of the above embodiments is applied to the air conditioner (1) for exchanging heat between air and refrigerant. However, the refrigeration system of this invention may be applied, for example, to cold/warm water chillers or water heaters for obtaining a cold water or a warm water by exchanging heat between heating medium, such as water, and refrigerant.

The above embodiments are merely preferred embodiments in nature and are not intended to limit the scope, applications and use of the invention.

Industrial Applicability

As can be seen from the above description, the present invention is useful for a refrigeration system including a compressor with a plurality of compression chambers and operative in a refrigeration cycle.

The invention claimed is:

1. A refrigeration system comprising:

a compressor that includes a compressor main unit constituting a positive-displacement fluid machine with a plurality of compression chambers to cyclically change the capacities of the compression chambers and a drive shaft for driving the compressor main unit; and a refrigerant circuit connected with the compressor and operable in a refrigeration cycle, wherein the compressor main unit is configured so that first and second said compression chambers differ in the phase of capacity changing cycle from each other by 180° and third and fourth said compression chambers differ in the phase of capacity changing cycle from each other by 180°, the compressor is selectively operable in a parallel compression mode in which refrigerant is compressed in a single stage in each of the first to fourth compression chambers and a cylinder nonoperating mode in which refrigerant is compressed in a single stage in each of the third and fourth compression chambers while compression of refrigerant in the first and second compression chambers is halted, and the first compression chamber is disposed below the second compression chamber in a direction along a rotating axis of the drive shaft and the third compression chamber is disposed below the fourth compression chamber in the direction along the rotating axis of the drive shaft.

2. A refrigeration system comprising:

a compressor that includes a compressor main unit constituting a positive-displacement fluid machine with a plurality of compression chambers to cyclically change the capacities of the compression chambers and a drive shaft for driving the compressor main unit; and a refrigerant circuit connected with the compressor and operable in a refrigeration cycle, wherein the compressor main unit is configured so that first and second said compression chambers differ in the phase of capacity changing cycle from each other by 180° and third and fourth said compression chambers differ in the phase of capacity changing cycle from each other by 180°, the compressor is selectively operable in a parallel compression mode in which refrigerant is compressed in a single stage in each of the first to fourth compression chambers and a two-stage compression mode in which refrigerant compressed in a single stage in each of the first and second compression chambers is further compressed in the third and fourth compression chambers, and the first compression chamber is disposed below the second compression chamber in a direction along a rotating axis of the drive shaft and the third compression chamber is disposed below the fourth compression chamber in the direction along the rotating axis of the drive shaft.

3. A refrigeration system comprising:

a compressor that includes a compressor main unit constituting a positive-displacement fluid machine with a plurality of compression chambers to cyclically change the capacities of the compression chambers and a drive shaft for driving the compressor main unit; and a refrigerant circuit connected with the compressor and operable in a refrigeration cycle, wherein the compressor main unit is configured so that first and second said compression chambers differ in the phase of capacity changing cycle from each other by 180° and third and fourth said compression chambers differ in the phase of capacity changing cycle from each other by 180°, the compressor is selectively operable in a two-stage compression mode in which refrigerant compressed in a single stage in each of the first and second compression chambers is further compressed in the third and fourth compression chambers and a cylinder nonoperating mode in which refrigerant is compressed in a single stage in each of the third and fourth compression chambers while compression of refrigerant in the first and second compression chambers is halted, and the first compression chamber is disposed below the second compression chamber in a direction along a rotating axis of the drive shaft and the third compression chamber is disposed below the fourth compression chamber in the direction along the rotating axis of the drive shaft.

4. A refrigeration system comprising:

a compressor that includes a compressor main unit constituting a positive-displacement fluid machine with a plurality of compression chambers to cyclically change the capacities of the compression chambers and a drive shaft for driving the compressor main unit; and a refrigerant circuit connected with the compressor and operable in a refrigeration cycle, wherein the compressor main unit is configured so that first and second said compression chambers differ in the phase of capacity changing cycle from each other by 180° and third and fourth said compression chambers differ in the phase of capacity changing cycle from each other by 180°, the compressor is selectively operable in a parallel compression mode in which refrigerant is compressed in a single stage in each of the first to fourth compression chambers, a cylinder nonoperating mode in which refrigerant is compressed in a single stage in each of the third and fourth compression chambers while compression of refrigerant in the first and second compression chambers is halted and a two-stage compression mode in which refrigerant compressed in a single stage in each of the first and second compression chambers is further compressed in the third and fourth compression chambers, and the first compression chamber is disposed below the second compression chamber in a direction along a rotatine axis of the drive shaft and the third compression chamber is disposed below the fourth compression chamber in the direction along the rotating axis of the drive shaft.

5. The refrigeration system of any one of claims 1 to 4, wherein the compressor main unit of the compressor includes a first compression mechanism and a second compression mechanism, each of the first and second compression mechanisms includes a cylinder forming an annular cylinder chamber and an annular piston placed in the cylinder chamber to partition the cylinder chamber into an inner space and an outer space and is configured to cause relative eccentric rotational motion between the cylinder and the piston with rotation of the drive shaft, the outer space in the cylinder chamber of the first compression mechanism constitutes the first compression chamber and the inner space therein constitutes the third compression chamber, and the outer space in the cylinder chamber of the second compression mechanism constitutes the second compression chamber and the inner space therein constitutes the fourth compression chamber.

6. The refrigeration system of any one of claims 1 to 4, wherein the compressor main unit of the compressor includes first to fourth rotary compression mechanisms that form their respective compression chambers corresponding to the first to fourth compression chambers, respectively.

7. The refrigeration system of claim 6, wherein the first compression chamber differs in the phase of capacity changing cycle from one of the third and fourth compression chambers by 180°.

8. A refrigeration system comprising:

a compressor that includes a compressor main unit constituting a positive-displacement fluid machine with a plurality of compression chambers to cyclically change the capacities of the compression chambers and a drive shaft for driving the compressor main unit; and a refrigerant circuit connected with the compressor and operable in a refrigeration cycle, wherein the compressor main unit is configured so that first and second said compression chambers differ in the phase of capacity changing cycle from each other by 180° and third and fourth said compression chambers differ in the phase of capacity changing cycle from each other by 180°, the compressor is selectively operable in a parallel compression mode in which refrigerant is compressed in a single stage in each of the first to fourth compression chambers and a cylinder nonoperating mode in which refrigerant is compressed in a single stage in each of the third and fourth compression chambers while compression of refrigerant in the first and second compression chambers is halted, and the first compression chamber and the second compression chamber are disposed in an axial direction along the drive shaft, and the third compression chamber and the fourth compression chamber are disposed in the axial direction along the drive shaft.

* * * * *